US010036170B2

(12) United States Patent
Panseri et al.

(10) Patent No.: US 10,036,170 B2
(45) Date of Patent: Jul. 31, 2018

(54) CLIMBING EQUIPMENT AND CLIMBING METHOD FOR THE CONSTRUCTION OF A BUILDING

(71) Applicant: DESPE S.p.A., Torre de' Roveri (IT)

(72) Inventors: Giuseppe Panseri, Torre de' Roveri (IT); Stefano Panseri, Torre de' Roveri (IT); Roberto Panseri, Torre de' Roveri (IT)

(73) Assignee: Despe S.p.A., Torre de' Roveri (IT)

( * ) Notice: Subject to any disclaimer, the term of this patent is extended or adjusted under 35 U.S.C. 154(b) by 0 days.

(21) Appl. No.: 15/581,465

(22) Filed: Apr. 28, 2017

(65) Prior Publication Data

US 2017/0226757 A1 Aug. 10, 2017

Related U.S. Application Data

(63) Continuation of application No. PCT/IB2016/056400, filed on Oct. 25, 2016.

(30) Foreign Application Priority Data

Oct. 27, 2015 (IT) ..... 102015000065962

(51) Int. Cl.
*E04G 3/28* (2006.01)
*E04G 3/20* (2006.01)
*E04G 11/28* (2006.01)

(52) U.S. Cl.
CPC ..... *E04G 3/28* (2013.01); *E04G 3/20* (2013.01); *E04G 11/28* (2013.01)

(58) Field of Classification Search
CPC ..... E04G 3/28; E04G 3/20; E04G 2003/286; E04G 11/28
(Continued)

(56) References Cited

U.S. PATENT DOCUMENTS 6,557,817 B2 * 5/2003 Waldschmitt ..... E04G 11/28 182/36
8,708,100 B2 * 4/2014 Schwoerer ..... E04G 11/28 182/20
(Continued)

FOREIGN PATENT DOCUMENTS

DE 2361110 A1 * 6/1975 ..... E04G 11/28
DE 2921636 A1 * 12/1980 ..... E04G 3/28
(Continued)

*Primary Examiner* — Katherine W Mitchell
*Assistant Examiner* — Marcus Menezes
(74) *Attorney, Agent, or Firm* — Blank Rome LLP

(57) ABSTRACT

Climbing equipment for the construction of a building, including a scaffold that at least partially surrounds the perimeter of a building floor and is provided with a walkable surface. The climbing equipment includes a traction device comprising a first portion integral with the scaffold, and a second portion connected to the first portion. The first portion includes a first coupling element adapted to grip a first coupling portion of the building, and the second portion includes a second coupling element, arranged at a different level than the first coupling element, and adapted to grip a second coupling portion of the building. The climbing equipment further comprises a moving system. When the first coupling element is released from the respective coupling portion, the moving system performs a relative movement between the first portion and said second portion of the traction device, so as to move the scaffold by a predetermined amount.

10 Claims, 19 Drawing Sheets

(58) Field of Classification Search
USPC ..... 182/82
See application file for complete search history.

(56) References Cited

U.S. PATENT DOCUMENTS

| | | | | |
|---|---|---|---|---|
| 9,175,487 | B2 * | 11/2015 | Iturbe Beristain | E04G 21/16 |
| 2002/0157900 | A1 * | 10/2002 | Ono | E04G 3/00 182/82 |
| 2003/0052249 | A1 * | 3/2003 | Waldschmitt | E04G 11/28 249/20 |
| 2011/0214824 | A1 * | 9/2011 | Beristain | E04G 21/16 160/368.1 |
| 2015/0101887 | A1 | 4/2015 | Schwoerer | |

FOREIGN PATENT DOCUMENTS

| | | | | |
|---|---|---|---|---|
| DE | 19920164 | A1 * | 11/1999 | E04G 3/28 |
| EP | 2 365 159 | B1 | 9/2011 | |
| FR | 2487892 | A1 * | 2/1982 | E04G 3/28 |
| JP | 7-76934 | A | 3/1995 | |
| JP | 7-189491 | A | 7/1995 | |
| JP | 2002-194893 | A | 7/2002 | |
| KR | 10-0862275 | B1 | 10/2008 | |
| KR | 10-2013-0077176 | A | 7/2013 | |
| NL | 8004572 | A | 3/1982 | |
| WO | WO 2007121993 | A1 * | 11/2007 | B66B 9/187 |

* cited by examiner

CLIMBING EQUIPMENT AND CLIMBING METHOD FOR THE CONSTRUCTION OF A BUILDING

This is a continuation of International Application No. PCT/IB2016/056400, filed on Oct. 25, 2016, which claims priority to Italian Patent Application No. 102015000065962, filed on Oct. 27, 2015, the entire disclosures of which are incorporated by reference herein.

BACKGROUND OF THE INVENTION

1. Field of the Invention

The present invention relates to climbing equipment and to a climbing method for the construction of buildings, even for buildings of particular height extension, such as skyscrapers or high-rise blocks.

In particular, the present invention relates to self-climbing equipment for the construction of a building and to a climbing method.

More in particular, the present invention relates to climbing equipment for the construction of buildings preferably having a steel supporting structure.

2. Description of the Related Art

Equipment for the construction of buildings, even of considerable height, e.g. skyscrapers or high-rise blocks, are known, comprising at least one scaffold which by resting on the ground or on the building base extends over the entire height of the building under construction. Scaffold solutions anchored to portions of the building under construction are also known. Solutions of this type are invasive and require long times to construct a height increase of the scaffold as the building under construction increases in height.

For example, document JP-H-0776934-A shows a steel skeleton adapted to hang from the structure of a skyscraper under construction, comprising a winch, adapted to cooperate with a crane for lifting building materials and deliver them to the level of the floor to be built. This solution requires the steel skeleton to be hung at a much higher level than the level of the floor to be built.

Equipment is also known for the construction of buildings, comprising a scaffold and a scaffold ascent system, adapted to climb up the building under construction. For example, Korean patent No. KR-100862275-B1 shows a scaffold for the construction of skyscrapers comprising a scaffold ascent system with respect to the building under construction comprising a screw actuator.

Although this solution is partially advantageous, it however requires to embed anchoring pins within the material of the wall of the building under construction, e.g. made of concrete, and thus requires to wait for the construction material to solidify for the scaffold to ascend safely, thus imposing long waits before safely ascending the scaffold.

For example, European patent No. EP-2365159-B1 shows ascending equipment for the construction of buildings comprising a scaffold adapted to climb up the building under construction. The scaffold comprises at least one pair of anchors which are screwed to at least two floors of the building arranged at different heights, so as to allow the sliding of the scaffold with respect to guide rings connected to the anchors. A jack moves the scaffold upwards. A platform projects like a cantilever from the movable scaffold outwards, i.e. in an opposite direction with respect to the extension of the pair of anchors. However, the solution described above requires to spend time to screw the anchors to the upper floors of the building under construction. Furthermore, including a platform which projects like a cantilever from the movable scaffold towards the opposite side with respect to the side of the anchors to the building under construction offers neither satisfactory safety for operators nor sufficient protection from the danger of falling objects or construction materials.

For example, document US-2015-101887-A1 shows a lifting device of a movable scaffold which comprises a jack which is anchored to the building under construction and pushes the scaffold upwards. A solution of this type requires to anchor and free the jack to and from the building under construction to allow the scaffold to ascend as new floors of the building under construction are constructed. Further examples of equipment for the construction of buildings are known from documents KR-2013-0077176-A and JP-2002-194893-A.

For example, document NL-8004572-A shows a telescopically extensible scaffolding system for curved walled towers made of reinforced concrete, in which brackets are embedded in the concrete of the tower to serve as support for the scaffolding system. This solution requires a laborious preparation and a slow telescopic extension process of the scaffolding system which must be fixed by means of pins to the brackets embedded in the concrete of the tower.

For example, document JP-H07-89491-A shows a scaffolding system which entirely surrounds a previously built floor of a building and comprises a telescopic moving system.

The aforesaid solutions do not provide adequate protection for operators and at the same time fail in preventing the falling of equipment and debris from the scaffolding in a satisfactory manner. At the same time, the mentioned solutions require long moving times of the scaffolding in vertical or subvertical direction and thus impose long waits before making even only part of the building usable.

The need is thus felt to provide climbing equipment and a climbing method for the construction of buildings, even for buildings of particular height extension, such as skyscrapers or high-rise blocks, capable of avoiding the drawbacks of the prior art.

SUMMARY OF THE INVENTION

It is the object of the present invention to provide a solution to the need to provide climbing equipment and a climbing method, for the construction of buildings, even of buildings of particular height extension, such as skyscrapers and high-rise blocks, for example, which is non-invasive, safe and adapted to allow the construction of the building in a rapid manner.

It is an object of the present invention to provide a solution to the need to provide climbing equipment and a climbing method for the construction of buildings having a structure consisting of steel uprights adapted to allow the use of at least part of the building under construction rapidly, or more rapidly than known solutions.

It is a further object of the present invention to devise a solution to the need to provide a climbing system for the construction of buildings adapted to rapidly ascend the building in an agile and concurrently safe manner.

This and other objects are achieved by a system as set forth in the appended independent claims.

Some advantageous embodiments are the subject matter of the dependent claims.

According to an aspect of the invention, climbing equipment for the construction of a building, or of a building under construction, comprising a plurality of building floors, comprises at least one scaffold, adapted to surround at least partially the perimeter of at least one building floor, wherein the scaffold comprises at least one work platform, adapted to form a walkable surface and adapted to project like a cantilever from the scaffold towards the building under construction, wherein at least some of the work platforms are adapted to close the open space between the scaffold and the building under construction.

According to an aspect of the invention, the climbing equipment further comprises a traction device comprising a first portion integral with the scaffold, and a second portion connected to the first portion, wherein the first portion comprises a first coupling element and the second portion comprises a second coupling element, and wherein the first coupling element is adapted to grip a first coupling portion of the building under construction and wherein the second coupling element is adapted to grip a second coupling portion of the building under construction, and wherein the first coupling portion is arranged at a different level than the second coupling portion, and wherein the climbing equipment further comprises a moving system, adapted to perform a relative movement between the first portion and the second portion of the traction device, and wherein when a first coupling element is released from the respective coupling portion of the building under construction, the moving system is adapted to perform a relative movement between the first portion and the second portion of the traction device, so as to move the scaffold by a predetermined movement defining a direction of relative movement.

According to an aspect of the invention, the extension of the scaffold parallel to the direction of relative movement X between the first portion and the second portion of the traction device is greater than the first portion by a predetermined amount.

According to an aspect of the invention, the predetermined amount is greater than the height of a building floor.

According to an aspect of the invention, climbing equipment for the construction of buildings comprising a scaffold which at least partially, or even entirely, surrounds the side perimeter of a building under construction, avoiding to have a supporting structure which is arranged by the side of the building also extending beyond the floor temporarily under construction so as to ensure the safety of workers even during the construction of new floors. Advantageously, such climbing equipment and such a climbing method for the construction of buildings is adapted to provide the building to be constructed rapidly and discreetly, and this allows to use the floors already built of the building under construction.

BRIEF DESCRIPTION OF THE DRAWINGS

Further features and advantages of the equipment and method according to the invention will be apparent from the description provided below of preferred embodiments thereof, given by way of non-limiting example, with reference to the accompanying drawings, in which.

DETAILED DESCRIPTION OF THE PREFERRED EMBODIMENTS

Figure 1:
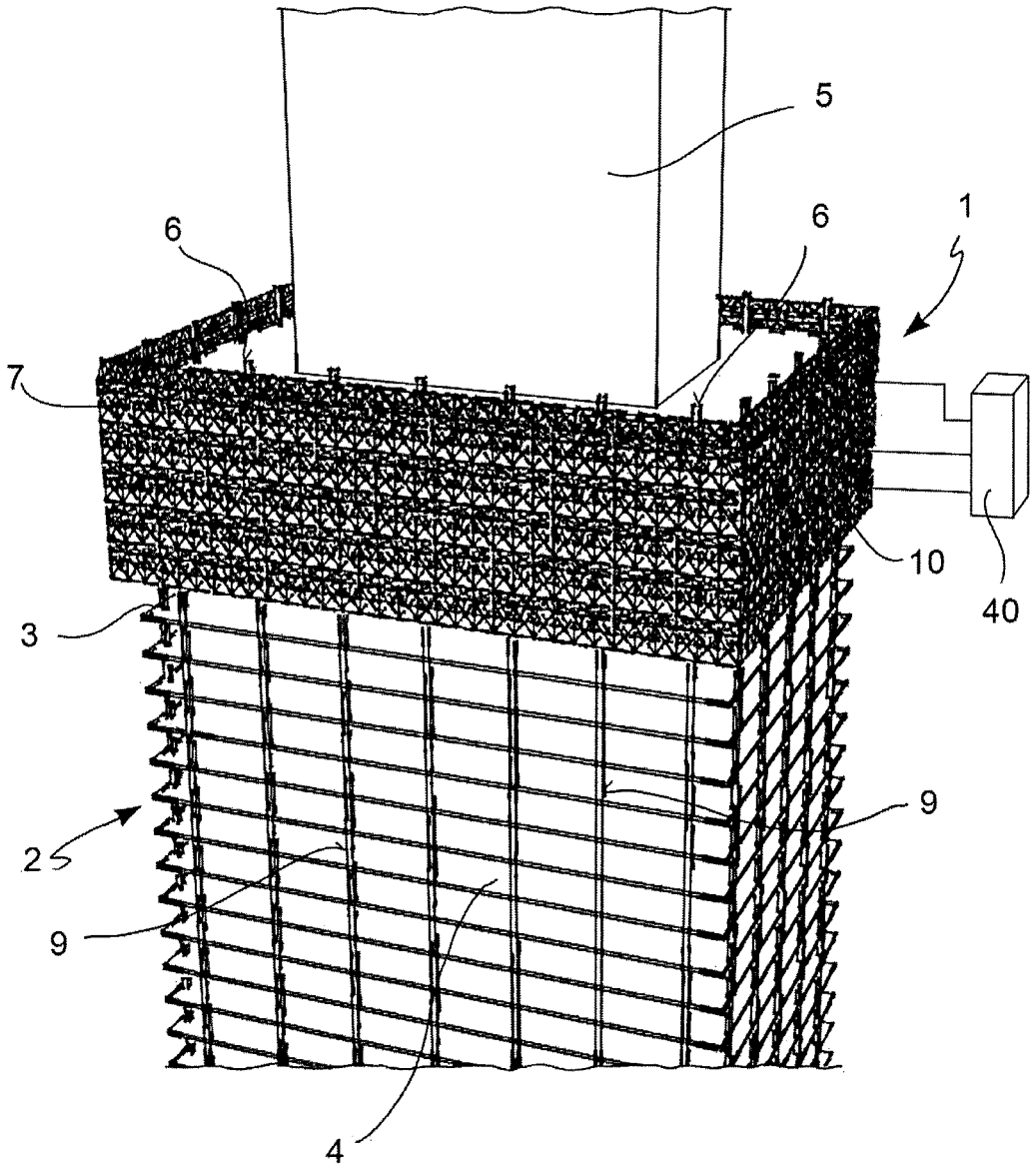
FIG. 1 is a schematic axonometric view which shows climbing equipment for the construction of buildings according to an embodiment.
Figure 4:
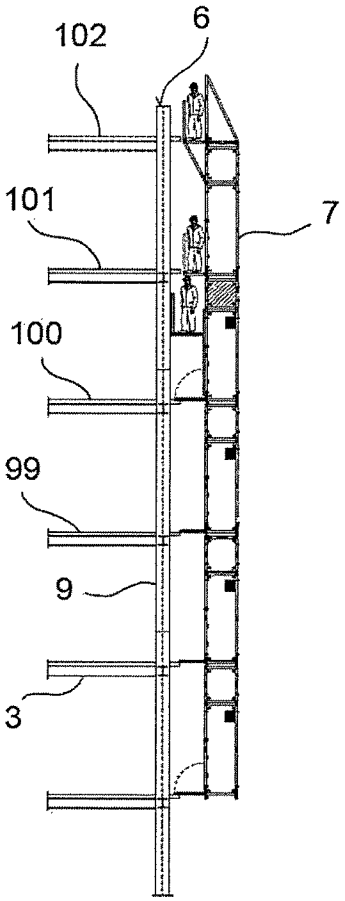
FIGS. 2, 3 and 4 are schematic section views which illustrate parts of equipment according to some embodiments of the invention, as possible steps of a method according to possible modes of operation.
Figure 3:
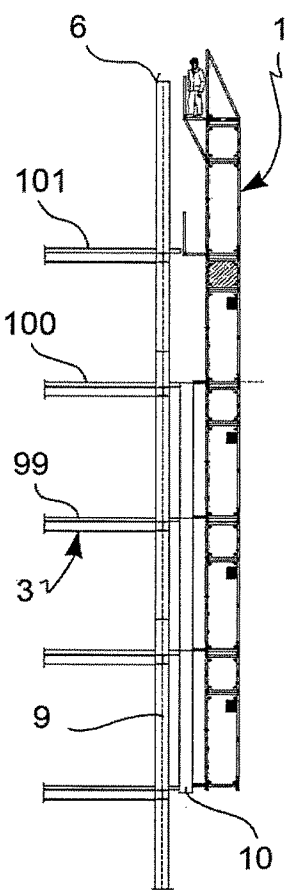
Figure 2:
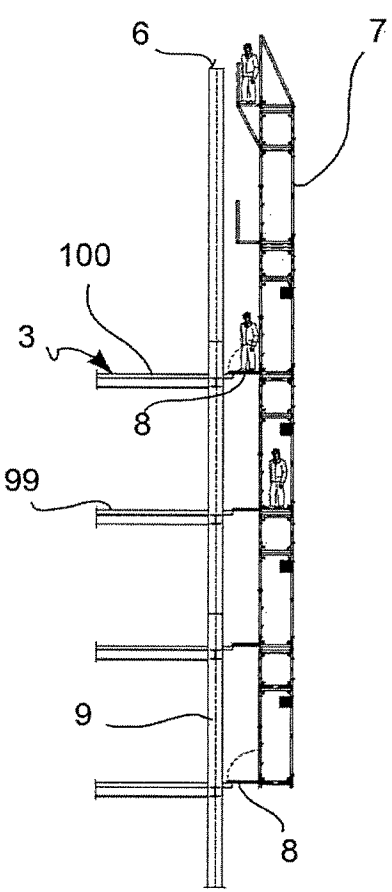

According to a general embodiment, climbing equipment 1 for the construction of a building 2, or building under construction 2, comprises at least one scaffold 7, or scaffolding 7. For example, the climbing equipment 1 is self-climbing equipment for the construction of a building 2.

According to an embodiment, the building under construction 2 is a building having a particular height extension, such as a skyscraper or a high-rise block, for example.

Preferably, the building under construction 2 comprises a metal frame structure, e.g. made of steel, iron or the like. More preferably, the frame structure of the building under construction 2 comprises a plurality of metal uprights, e.g. made of steel, iron or the like.

Building 2, or building under construction 2, comprises a plurality of floors 3. According to an embodiment, "height of a floor 90" means the measurement of the substantially vertical distance between the flooring of a floor and the ceiling of the consecutive, upper floor of the building. For example, the height of a building floor 90 may be comprised between about 2 meters and about 4 meters, and preferably comprised between about 2.5 meters and 3.5 meters. Therefore, the height of two building floors is substantially equal to double the height of one floor 90 of the building 2.

The climbing equipment 1 comprises at least one scaffold, or scaffolding 7, adapted to at least partially surround the perimeter of at least one building floor 3. Preferably, the scaffold 7 surrounds at least partially the perimeter of a plurality of building floors 3.

The scaffold 7 comprises at least one work platform 8, adapted to form a walkable surface and adapted to project like a cantilever from the scaffold 7 towards the building under construction 2, in which at least some of the work platforms 8 being adapted to close the open space between the scaffold 7 and the building under construction 2. Preferably, the work platform is overturnable. In other words, the work platform 8 is overturnable and can pass from at least one extended position, in which it forms a walkable surface which projects like a cantilever from the scaffold 7 towards the building under construction 2, to at least one retracted position, in which it is substantially contained within the clearance of the scaffold 7.

Including the work platform 8 confers a high degree of safety for operators and a high degree of protection against the accidental falling of objects, debris or other building materials. Furthermore, including such an extensible work platform 8, when in folded position, prevents interfering with the ascending movement of the climbing equipment 1.

According to an embodiment, the scaffold 7 comprises at least one scaffolding which defines a walkable surface within the clearance of the scaffolding 7. According to an embodiment, the work platform 8, when it is in extended position, creates a continuous walkable surface with the scaffolding. The term "continuous walkable surface" does not mean that there is a seamless surface between scaffolding and work platform 8, but that the scaffolding and the work platform 8 form a walkable portion so that an operator can easily and safely move from the work platform 8 to the scaffolding, and vice versa. Preferably, in the building under construction 2, a theoretical peripheral facade surface is defined, comprising one or more theoretical facade surfaces oriented substantially in either vertical or subvertical direction and coinciding with the extension of the previously constructed facades of the building under construction.

According to an embodiment, the scaffold 7 comprises at least one protective barrier 36 which extends along the outer edge of the scaffold 7. According to an embodiment, the scaffold 7 comprises a protective cage which extends along the outer edge of the scaffold 7. Thereby, increased safety and ease of operation is provided for workers 200 and other operators, as well as an increased degree of protection against the accidental falling of objects, debris and other construction materials. Including the protection cage and the work platform 8 allows to provide a scaffold which protects the building under construction 2 like a cocoon.

The climbing equipment 1 further comprises a traction device 10 comprising at least a first portion 11, or first ascending portion 11, integral with the scaffold 7, and at least a second portion 12, or second ascending portion 12, connected to the first portion 11. According to an embodiment, the second portion 12 is slidingly connected to the first portion 11. According to an embodiment, the scaffold 7 is associated with the first portion 11 and the first portion 11 is fitted in a sliding manner on the second portion 12 of the traction device 10. According to an embodiment, the first portion 11 associated with the scaffold 7 embraces the second portion 12 of the traction device 10. According to an embodiment, the first portion 11 of the traction device 10 comprises mutually shaped sliding guides 45 with respect to sliding runners 46 provided on the second portion 12 of the traction device 10. Alternatively, the second portion 12 of the traction device 10 comprises mutually shaped sliding guides with respect to sliding runners provided on the first portion 11 of the traction device 10.

According to an embodiment, the scaffold 7 is associated with the first portion 11 so as to project like a cantilever forming at least one attachment portion to the first portion 11 of the traction device 10 and at least one suspended cantilevered portion. The suspended cantilevered portion of the scaffold 7 extends from the first portion 11 in opposite direction with respect to the building under construction 2.

According to a preferred embodiment, the extension of the scaffold 7 parallel to the direction of relative movement X between the first portion 11 and the second portion 12 of the traction device 10 is greater than the first portion 11 by a predetermined amount 14. Thereby, the scaffold 7 comprises an excess portion 17, which extends surrounding at least one portion of the theoretical peripheral facade surface. Preferably, the predetermined amount 14 is substantially equal to the height of a building floor 90. Preferably, the predetermined amount 14 is greater than the height of a building floor 90. Preferably, the predetermined amount is substantially equal to the height of two building floors. In other words, the predetermined amount is substantially equal to twice the height of a building floor 90. Thereby, the number of vertical movements of the equipment 1 can be reduced, and substantially halved, with respect to envisaging the predetermined amount substantially equal to a height of a floor 90 of the building 2.

The provision of such a scaffold 7 having a greater extension than the first portion 11 by a predetermined amount 14 allows the workers to work on the construction of the floors 101, 102 of the building under construction 2 which are higher than the highest of the previously built floors of the building under construction 2. Furthermore, by including the extensible work platforms 8, it is possible to close the open space between the scaffold 7 and the theoretical peripheral surface of the building under construction 2.

According to an embodiment, the height extension of the scaffold 7 is greater than the second portion 12 of the traction device 10. Preferably, the second portion 12 of the traction device 10 extends higher up than the first portion 11 of the traction device 10 both during the building ascending climbing movement and when the traction device 10 is stopped.

According to an embodiment, the second portion 12 is freely movable with respect to the first portion 11 while being constrained to it at least in one portion thereof. According to an embodiment, the traction device 10 comprises at least one low-friction material layer 13 interposed between the first portion 11 of the traction device 10 and the second portion 12 of the traction device 10 to promote the sliding between the first portion 11 and the second portion 12 of the traction device 10. Preferably, the low-friction material layer is made of Polizene.

The first portion 11 comprises at least a first coupling element 21. The second portion 12 comprises at least a second coupling element 22. The first coupling element 21 is adapted to grip a first coupling portion 31 of the building under construction 2. The second coupling element 22 is adapted to grip a second coupling portion 32 of the building under construction 2.

Preferably, the frame structure of the building under construction 2 comprises both the first coupling portion 31 and the second coupling portion 32. Preferably, the uprights of the frame structure comprise both the first coupling portion 31 and the second coupling portion 32. More preferably, the uprights of the frame structure comprise a plurality of first coupling portions 31 and a plurality of second coupling portions 32. Preferably, the section of each of the uprights decreases upwards.

Preferably, more than one of the first coupling portion 31 and more than one of the second coupling portion 32 are provided for each floor of building under construction. The pitch of the climbing equipment 1 is so determined. For example, the traction device 10 performs two extension cycles to ascend each floor, during the climbing movement.

According to an embodiment, the climbing equipment 1 comprises further coupling elements 20, adapted to grip further coupling portions 30 of the building under construction 2.

According to an embodiment, in the accompanying figures, each of the first coupling element 21 and the second coupling element 22 may also be indicated by reference numeral 20, where the first coupling element 21 and the second coupling element 22 are functionally indistinguishable. Furthermore, reference numeral 20 may generally indicate a coupling element. In the accompanying figures, each the first coupling portion 31 and the second coupling portion 32 could also be indicated by reference numeral 30, where the first coupling element 31 and the second coupling element 32 are functionally indistinguishable. Furthermore, reference numeral 30 may generally indicate a coupling portion.

Preferably, the first coupling portion 31 is arranged at a different level than the second coupling portion 32. According to an embodiment, the first coupling portion 31 is connected at a lower level than the second coupling portion 32. In other words, the second coupling portion 32 is arranged higher than the first coupling portion 31. A same coupling portion 30 may work either as a first coupling portion 31 or as second coupling portion 32, preferably at different times. According to a different embodiment, the first coupling portion 31 is connected at a higher level than the second coupling portion 32.

The climbing equipment 1 further comprises a moving system 15, adapted to perform a relative movement between the first portion 11 and the second portion 12 of the traction device 10.

According to an embodiment, when at least either the first coupling element 21 or the second coupling element 22 is released from the respective coupling portion 31, 32, the moving system 15 is adapted to perform a relative movement between the first portion 11 and the second portion 12 of the traction device 10, so as to move the scaffold 7 by a predetermined movement.

According to an embodiment, when at least either the first coupling element 21 or the second coupling element 22 is released from the respective coupling portion 31, 32, the moving system 15 moves the first portion 11 with respect to the second portion 12 so as to move the scaffold 7 by a predetermined movement.

According to an embodiment, the predetermined movement of the scaffold 7 is a lifting movement. In other words, the movement is directed prevalently upwards. In other words, the predetermined movement of the scaffold 7 is a raising movement.

According to an embodiment, the scaffold 7 is associated with the first portion 11 of the traction device 10 like a backpack that the first portion 11 carries therewith during the relative movement of the first portion 11 of the traction device 10 with respect to the second portion 12 of the traction device 10. Thereby, a clear raising movement of the scaffold 7 can be created during the construction of a building.

According to an embodiment, the second coupling portion 32 is arranged higher than the first coupling portion 31, and when the first coupling element 21 is released from the first coupling portion 31 and the second coupling element 22 is anchored to the second coupling portion 32, the moving system 15 moves from the first portion 11 with respect to the second portion 12, so as to lift the scaffold 7, connected to the first portion 11.

According to an embodiment, the predetermined movement involves the scaffold 7 as a whole. In other words, all parts of the scaffold 7 are moved simultaneously with the predetermined movement. According to an embodiment, the climbing equipment 1 comprises a plurality of traction devices 10. For example, the climbing equipment 1 comprises sixteen traction devices 10 distributed along the peripheral extension of the scaffold 7.

According to a different embodiment, the predetermined movement of the scaffold 7 is a lowering movement. In other words, the movement is directed prevalently downwards.

According to an embodiment, the moving system 15 comprises at least one hydraulic actuator. For example, it may comprise at least one cylinder-piston assembly. According to an embodiment, the moving system 15 comprises at least one mechanical actuator. According to an embodiment, the moving system 15 comprises at least one electrical-mechanical actuator. According to an embodiment, the moving system 15 comprises at least one jack 16.

According to an embodiment, the second portion 12 is telescopically connected to the first portion 11 of the traction device 10. According to an embodiment, the traction device 10 comprises a telescopic system, adapted to pass from the contracted configuration to the extended configuration, and vice versa, by means of the relative sliding between the first portion 11 and the second portion 12.

Including the telescopic system allows the traction device 10 to extend and contract while ensuring that the first portion 11 and the second portion remain mutually aligned or in axis.

According to an embodiment, the second portion 12 is adapted to form the telescopically extensible portion of the traction device 10. Advantageously, the second portion 12 is free from the connection with the scaffold 7.

According to an embodiment, the second portion 12 slides along at least one guiding channel defined by a reciprocally shaped portion of the first portion 11 of the traction device 10. According to an embodiment, the second portion 12 slides along at least one guiding channel defined by a reciprocally shaped portion of the first portion 11 of the traction device 10. According to an embodiment, the first coupling element 21 is rotationally connected to the first portion 11 of the traction device 10. For example, the rotational constraint comprises a fixing pin 26. According to an embodiment, the second coupling element 21 is adapted to project like a cantilever from the first portion 11 of the traction device 10, as a shelf. According to an embodiment, the second coupling element 22 is rotationally connected to the second portion 12 of the traction device 10. For example, the rotational constraint comprises a fixing pin 26. According to an embodiment, the second coupling element 22 is adapted to project like a cantilever from the first portion 12 of the traction device 10, like a shelf.

Preferably, the first coupling element 20, 21 and second coupling element 20, 22 are overturnable within a position projecting like a cantilever from the traction device 10 and a folded or non-projecting position, so as not to interfere with the ascent of the building under construction 1.

According to an embodiment, the first coupling element 21 is connected to a first actuator 41 for moving it between a coupling position, in which it is anchored to the first coupling portion 31, and a releasing position, in which it is not in contact with the first coupling portion 31. Preferably, the first actuator 41 is a hydraulic or pneumatic actuator. Preferably, the first actuator 41 comprises a cylinder-piston assembly. Preferably, the first actuator 41 is extensible within a retracted configuration and an extended configuration. Preferably, when the first actuator 41 is in retracted position, it determines that the first coupling element 21 is in position projecting like a cantilever from the first portion so as to couple to a coupling portion 30, 31 of the building under construction 2. Preferably, when the first actuator 41 is in extended configuration, it determines that the first coupling element 21 is in folded or non-projecting position so as to allow the ascent of the building under construction 1 by moving the traction device 10.

According to an embodiment, said second coupling element 22 is connected to a second actuator 42 for moving it between a coupling position, in which it is anchored to said second coupling portion 32, and a releasing position, in which it is not in contact with second first coupling portion 32.

Preferably, said second actuator 42 is a hydraulic or pneumatic actuator. Preferably, said second actuator 42 comprises a cylinder-piston assembly. Preferably, said second actuator 42 is extensible within a retracted configuration and an extended configuration. Preferably, when said second actuator is in retracted position 42, it determines that said second coupling element 22 is in position projecting like a cantilever from said second portion so as to couple to a coupling portion 30, 32 of the building under construction 2. Preferably, when said second actuator 42 is in extended position, it determines that said second coupling element 22 and is in folded or non-projecting position so as to not interfere with the ascent of the building under construction 1.

Preferably, the first actuator 41 extends upwards from the first coupling element 21 to reach the first portion 11 of the traction device 10. Preferably, the second actuator 42 extends upwards from the second coupling element 22 to reach the first portion 12 of the traction device 10.

Such a first coupling element 21 and a second coupling element 22 being overturnable and moved by the first actuator 41 and second actuator 41 extending above a first coupling element 21 and a second coupling element 22, respectively, allow to direct the overturning direction favorably so as to contrast the accidental overturning when the climbing equipment 1 is coupled to the building under construction 2.

According to an embodiment, at least either the first actuator 41 or the second actuator 42 comprises at least one hydraulic actuator. For example, the hydraulic actuator is a cylinder-piston assembly.

According to an embodiment, the equipment 1 comprises a pair of first coupling elements 21, arranged at mutually different levels. This improves the anchoring performance. According to an embodiment, the equipment 1 comprises a pair of first coupling elements 21, arranged substantially at the same level. This improves the anchoring performance.

According to an embodiment, the equipment 1 comprises a pair of second coupling elements 22, arranged at a different level from each other. This improves the anchoring performance. According to an embodiment, the equipment 1 comprises a pair of second coupling elements 22, arranged substantially at the same level. This improves the anchoring performance. According to an embodiment, at least either the first coupling element 21 or the second coupling element 22 comprises a hook 23. According to an embodiment, each first coupling element 21 and second coupling element 22 comprise a hook 23. According to an embodiment, the first coupling portion 31 is arranged higher than the second coupling portion 32.

According to an embodiment, at least either the first coupling portion 31 or the second coupling portion 32 comprises a coupling pin 33, or coupling peg 33, adapted to be accommodated in a hole made in a supporting pillar 9, or pillar 9, or upright 9, of the building under construction 2. The provision of a coupling peg 33 makes its positioning in the supporting pillar 9 quick and accurate. For example, a fixing peg 33 may be inserted into holes provided in the supporting pillar 9. This avoids spending time to anchor or couple the traction device 10 to the building under construction 2. Furthermore, if at least one hole must be made in the supporting pillar 9 to insert the fixing peg 33, the provision of a fixing peg makes the operation quick and easy. According to an embodiment, the coupling pin comprises two opposite ends which project like a cantilever from a profiled supporting pillar 9, the two opposite ends are adapted to form a coupling site for a pair of first coupling elements 21 of the first portion 11 of the traction device 10, and a central portion, interposed between the two ends and doubly constrained to the supporting pillar 9, to form a coupling site for at least a second coupling element 12 of the second portion 12 of the traction device 10. Preferably, the cross section of the coupling pin 33 is greater in the ends which project like a cantilever from the doubly constrained central portion so as to prevent flexural deformations of the cantilevered ends to ensure a firm coupling of the first portion 11 of the traction device 10.

According to an embodiment, the coupling element 20, 21 or 22 comprises a seat portion 25, adapted to accommodate the coupling peg 33 at least partially. According to an embodiment, the seat portion 25 is shaped so as to form a plurality of peg seats 27, each adapted to accommodate the coupling peg 33 at least partially. For example, the plurality of peg seats 27 are adapted to allow a coupling while minimizing the presence of mechanical clearance even when the distance between the coupling elements 20, 21, 22 and the respective coupling portions 30, 31, 32 is different from that envisaged during the step of designing.

According to an embodiment, the second portion 12 of the traction device 10 comprise an extensible resting foot 28, adapted to rest on a portion of the building under construction 2 to keep the climbing equipment 1 substantially parallel to the outer face of the building under construction 2, during the movement of the traction device 10.

According to an embodiment, the coupling peg 33 is fixed in a portion to a supporting pillar 9 of the building under construction 2 so as to provide at least one cantilevered portion, like a shelf.

Preferably, the supporting pillar 9 is a profiled beam.

According to an embodiment, the coupling peg 33 is fixed in two disjointed portions thereof to at least one supporting pillar 9 of the building under construction, like a double jointed beam. According to an embodiment, at least either the first coupling element 21 or the second coupling element 22 comprises a bushing 24, adapted to surround at least one portion of the coupling peg 33 so as to locally increase the outer diameter thereof. According to an embodiment, the coupling peg 33 comprises a coupling face 35, adapted to mate with the seat portion 25 of its associated coupling element 20, 21 or 22.

According to an embodiment, the coupling face 35 is a smooth surface. According to an embodiment, the coupling face 35 is at least partially knurled. According to an embodiment, the coupling face 35 is at least partially threaded. According to an embodiment, the tapped bushing is adapted to be coupled to the coupling peg when the coupling peg comprises the threaded coupling face. According to an embodiment, the coupling peg 33 comprises at least one portion having a decreased section portion to form a coupling groove. This provides the coupling between coupling pin 33 and coupling element 20.

According to an embodiment, the height extension of the scaffold 7 is at least equal to one building floor 3. According to an embodiment, the height extension of the scaffold 7 is equal to a plurality of building floors 3 and less than the height extension of the building under construction 2. In other words, the scaffold 7 is unsuitable to extend for the entire height extension of the building under construction 2. The provision of a scaffold 7 of smaller height extension than the height extension of the building under construction 2 allows to freely use and employ the building floors 3 which have already been built and which are arranged at lower heights than the first lower floor 99. Indeed, the building floors which were previously built and which are arranged at lower levels than the first lower floor 99, become in actual fact habitable even if the building under construction 2 has only been partially built when the climbing equipment 1 ascends. This implies considerable advantages in economic terms.

According to an embodiment, the building under construction 2 may comprise an elevator shaft 5 made of concrete, for example, and adapted to deliver people to the level of a building floor 3. The climbing equipment 1 avoids to be connected to the elevator shaft 5.

According to an embodiment, the height extension of the scaffold 7 is such as to surround a temporary top floor 100, a first upper floor 101, arranged at a higher level than the temporary top floor 100 and adjacent to the temporary top floor 100, and a first lower floor 99, arranged at a lower level than the temporarily top floor 100 and adjacent to the temporary top floor 100. According to an embodiment, the term "temporary top floor 100" refers to the floor which is temporarily higher than the level at which the traction device 10 is anchored, before the first upper floor 101 or a further upper floor 102 is built. As the first top floor 101 and the further top floor 102 are constructed, the climbing equipment 1 may, for example, ascend and anchor itself to the level of a new floor which becomes the temporary top floor 100. According to an embodiment, the temporary top 6 of the supporting pillars 9 is always at a higher level than the temporarily top floor 100, so that the supporting pillars 9 work as supporting structures for the construction of the first upper floor 101.

According to an embodiment, the height extension of the scaffold 7 is such as to surround at least one useful space portion to build at least one further upper floor 102, arranged at a higher level than the first upper floor 101 and adjacent to the first upper floor 101.

According to a preferred embodiment, the extension of the scaffold 7 parallel to the direction of relative movement X between the first portion 11 of the traction device 10 and the second portion 12 of the traction device 10 is greater than the first portion 11 of the traction device 10 by a predetermined amount. Preferably, the predetermined amount is substantially equal to the height of one building floor 3. Thereby, the scaffold 7 comprises an excess portion 17, which extends so as to be adapted to surround at least partially at least one portion of the theoretical peripheral facade surface. In other words, the excess portion 17 of the scaffold 7 extends when the traction device 10 is stopped so as to be adapted to surround at least partially the top floor 100 and at least one upper floor 101.

Preferably, the predetermined amount is substantially equal to the height of two of the building floors 3. According to an embodiment, the excess portion 17 of the scaffold 7 extends when the traction device 10 is stopped to surround at least partially the top floor 100, at least one upper floor 101 and at least one further upper floor 102. Thereby, a more rapid construction of the building under construction 2 is allowed.

Preferably, the predetermined amount is greater than the height of two of the building floors 3. According to an embodiment, the excess portion 17 of the scaffold 7 extends when the traction device 10 is stopped to surround at least partially the top floor 100, at least one upper floor 101, at least one further upper floor 102 and at least two floors lower than the temporary top floor, even more preferably at least three floors lower than the temporary top floor 100.

With such climbing equipment 1, the workers 200 can safely work on the construction of the floors of the building under construction 2 which are higher than the highest of the floors which have already been built of the building under construction 2. Furthermore, by including the extendible work platforms 8, it is possible to close the open space between the scaffold 7 and the theoretical peripheral surface of the building under construction 2, thus providing increased safety for workers 200.

According to an embodiment, the supporting pillar 9 comprises a temporary pillar top 6. Preferably, the supporting pillar 9 is made of steel.

According to an embodiment, the climbing equipment 1 is adapted to move on the outer face 4 of the building under construction 2 leaving the temporary pillar top 6 free. According to an embodiment, the scaffold 7 avoids to encumber the temporary top 6. According to an embodiment, the scaffold 7 avoids to encumber the top of the building under construction 2.

According to an embodiment, the equipment 1 avoids to encumber the top of the building under construction 2 with beams or other structural elements.

According to an embodiment, the scaffold 7 is a modular scaffold comprising a plurality of modular scaffold modules M connected to form a scaffold having a predetermined height extension. According to an embodiment, the plurality of modular scaffold units M are connected to form a scaffold 7 having a predetermined extension about at least one portion of the building under construction 2. According to an embodiment, the modular scaffold units M each measure about 9 meters in length and about 3 meters in height.

The provision of the modular units also allows the climbing equipment 1 to vary its dimensions during the ascent by removing or adding one or more modular units, so as to enable to ascend buildings having converging and/or diverging walls. For example, such climbing equipment 1 is adapted to ascend skyscrapers or towers having a diamond shape.

According to an embodiment, the excess portion 17 of the scaffold comprises at least two of the modular scaffold units M associated vertically.

According to an embodiment, the scaffold 7 extends along the entire outer face 4 of the building under construction 2. In other words, according to an embodiment, the scaffold 7 is an annular scaffold. In yet other words, according to an embodiment, the scaffold 7 extends along the entire outer perimeter of the building under construction 2. The provision of an annular scaffold as described above allows to obtain improved safety for operators and improved production against the risk of accidental falling of objects, debris or other building materials, even in the presence of adverse atmospheric conditions, such as strong wing.

According to an embodiment, the scaffold 7 comprises at least one anchoring module 18 comprising an anchoring device to the first portion 11 of the traction device 10. According to an embodiment, the scaffold 1 comprises at least one working module 19, which can be associated with at least one anchoring module 18, and comprising at least one walkable surface and defining at least one working space adapted to safely accommodate one or more operators. Preferably, the working module 19 comprises at least one work platform 9. Preferably, the working module 19 comprises at least one protective barrier 36, adapted to prevent the accidental falling of objects from the working portion 19 of the scaffold 7.

According to an embodiment, the scaffold 7 is a modular scaffold and comprises a plurality of repetitive modular units M. According to an embodiment, a modular unit M of the scaffold 7 comprises an anchoring module 19 and a working module 18. According to an embodiment, a modular unit M of the scaffold 7 comprises a plurality of anchoring modules 19 and a plurality of working modules 18. According to an embodiment, a modular unit M of the scaffold 7 comprises at least one anchoring module 18. According to an embodiment, a modular unit M of the scaffold 7 comprises at least one working module 19. The provision of the modular scaffold units M makes the climbing equipment 1 adapted to be used for the construction of buildings of various form, such as towers and skyscrapers having particular architectures and, for example, a structure which broadens while ascending or, for example, having curved facades along the vertical direction or hyperbole-shaped facades. Indeed, adding or removing one or more modular units allows said scaffold 7 to take the desired dimensions.

According to an embodiment, said climbing equipment 1 comprises a plurality of said moving systems 15, distributed about the outer face of said building under construction 2 and connected to a plurality of traction devices 10. According to an embodiment, the plurality of traction systems 10 are distributed about the outer face 4 of the building under construction 2 and are connected by their first portion 11 to the scaffold 7. According to an embodiment, the traction device 10 is adapted to pass from at least one contracted configuration, of reduced height extension, to at least one extended configuration, of increased height extension with respect to the at least one contracted configuration.

According to an embodiment, at least either the first coupling portion 21 or the second coupling portion 22 is arranged on a supporting pillar 9 of the building under construction 2. In other words, at least either the first coupling portion 21 or the second coupling portion 22 is arranged on a pillar of the building under construction 2. According to an embodiment, the supporting pillar 9 is a portion of the supporting structure of the building under construction 2. According to an embodiment, the supporting pillar 9 is at least partially made of steel. According to an embodiment, the supporting pillar 9 is entirely made of steel. According to an embodiment, said supporting pillar 9 comprises a steel armature.

According to an embodiment, said climbing equipment 1 comprises a control system 40 adapted to detect and compensate for positioning errors of the scaffold 7, so as to keep the scaffold 7 leveled. In other words, the control system is adapted to keep the scaffold leveled even during the step of lifting or lowering of the scaffold 7. According to an embodiment, the control system 40 comprises at least one data processing unit adapted to process the data coming from a plurality of position sensors arranged in the scaffold 7. For example, the plurality of sensors may be arranged along a path of the scaffold 7 designed to be always at the same level. According to an embodiment, the control system 40 is adapted to actuate at least one moving system 15 to keep the scaffold 7 leveled. According to an embodiment, the climbing equipment 1 comprises a plurality of the moving systems 15 and the control system 40 is adapted to control each moving system 15 interdependently from the others to keep the scaffold 7 leveled.

The provision of the control system which allows to keep the scaffold 7 leveled improves the moving rapidity and accuracy and the positioning accuracy of the scaffold 7. This improves the reliability of the climbing equipment 1.

According to an embodiment, the plurality of traction systems 10 and the plurality of moving systems 15 are controlled in a monitored manner and using feedback by means of at least inclination sensors 44 of the scaffold 7 so as to keep the scaffold 7 always perfectly horizontally leveled both when parked and when moving. According to an embodiment, the inclination sensors 44 are distributed in a plurality of portions of the scaffold 7.

A climbing method for the construction of a building 2 is shown below.

According to a general embodiment, a climbing method for constructing buildings comprises the following steps, provided in the following order:

-A- providing at least one piece of climbing equipment 1 according to any one of the embodiments described above, coupled by means of the first coupling elements 21 and the second coupling elements 22 to the coupling portions 30, 31, 32 of, the pillars 9 of the building under construction 2, so that an excess portion 29 of the second portion 12 of the traction device 10 exceeds the height of the temporary top floor 100 of the building under construction 2;

-B- lifting the first portion 11 of the traction device 10 associated with the scaffold 7 with respect to the second portion 12 of the traction device 10 by an amount greater than the extension of the cantilevered portion of the first coupling elements 21, releasing the first coupling elements 21 of the first portion 11 of the traction device 10 from the coupling portions;

-C- moving away the first coupling elements 21 from the building under construction 2, taking them substantially within the clearance of the traction device 10;

-D- lifting the first portion 11 of the traction device 10 associated with the scaffold 7 with respect to the second portion 12 of the traction device 10 by a predetermined amount;

-E- approaching the first coupling elements 21 to the building under construction 2, by projecting them like a cantilever from the first portion 11 of the traction device 10;

-F- lowering the first portion 11 of the traction device 10 associated with said scaffold 7 with respect to said second portion 11 of the traction device 10 to couple said first coupling elements 21 to coupling portions provided in the pillars 9 of the building under construction 2;

-G- lifting said second portion 12 of the traction device 10 with respect to said first portion 11 of the traction device 10 by an amount greater than the extension of the cantilevered portion of the second coupling elements 22, releasing the second coupling elements 22 of the second portion 12 of the traction device 10 from the respective coupling portions;

-H- moving away the second coupling elements 22 from the building under construction 2, taking them substantially within the clearance of the traction device 10;

-I- lifting the second portion 12 of the traction device 10 with respect to the first portion 11 of the traction device 10 by a predetermined amount;

-J- approaching the second coupling elements 22 to the building under construction 2, by projecting them like a cantilever from the second portion 12 of the traction device 10;

-K- lowering the second portion 12 of the traction device 10 with respect to the first portion 11 of the traction device 10 to couple the second coupling elements 22 to coupling portions provided in the pillars 9 of the building under construction 2;

-L- repeating the preceding steps from -B- to -K-.

According to a possible mode of operation, the method comprises the following steps of including, before the step -B-, the step of resting the extensible resting foot 28 against the building under construction 2, and before the step -G-, of retracting the extensible resting foot 28.

According to a possible mode of operation, the method comprises after step -K-, the further step of overturning the work platform 8, so as to take it to an extended position, in which it forms a walkable surface which projects like a cantilever from the scaffold 7 towards said building under construction 2.

According to a possible mode of operation, the method comprises the following further steps:

coupling at least two of the first coupling elements 21 to the ends of a coupling pin 33 which project like a cantilever from a pillar 9 of the building under construction 2;

coupling at least a second coupling element 22 in the central portion of a coupling pin 33 interposed between the two cantilevered ends doubly constrained to the pillar 9.

According to a possible mode of operation, the method comprises before step -B- or step -A-, the step of providing coupling pins 33 in a plurality of supporting pillars 9 of the building under construction 2.

According to a possible mode of operation, a climbing method for the construction of buildings comprises the following steps, provided in the following order:

providing climbing equipment 1 according to any one of the embodiments described herein;

temporarily coupling the climbing equipment 1 to a temporary top floor 100 by means of the first portion 11 of the traction device 10;

at least partially building a first top floor 101;

temporarily coupling the second portion 12 of the traction device 10 to the first upper floor 101;

coupling the first portion 11 of the traction device 10;

moving the first portion 11 of the traction device 10 lifting the scaffold 7 connected to it.

Figure 7:
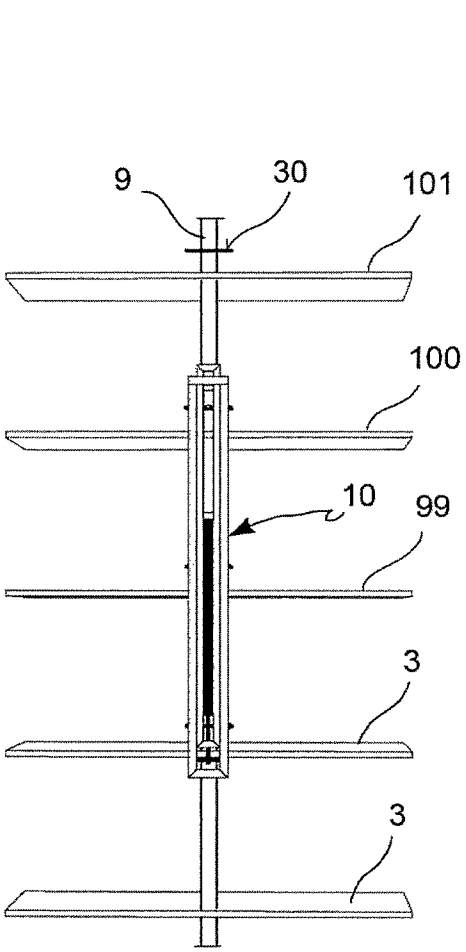
FIGS. 5, 6 and 7 are axonometric or perspective views which illustrate details of equipment according to an embodiment, as well as a step of a method according to a possible mode of operation.
Figure 6:
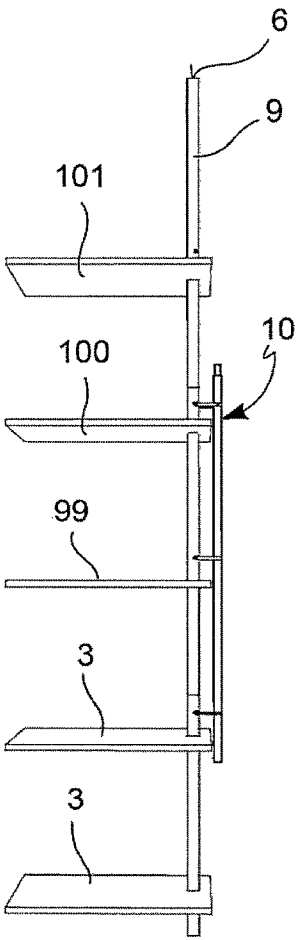
Figure 5:
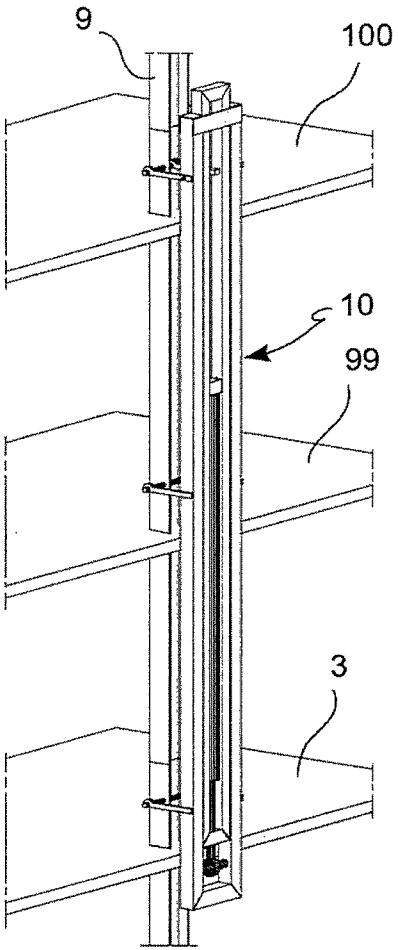
Figures 8, 9, 10:
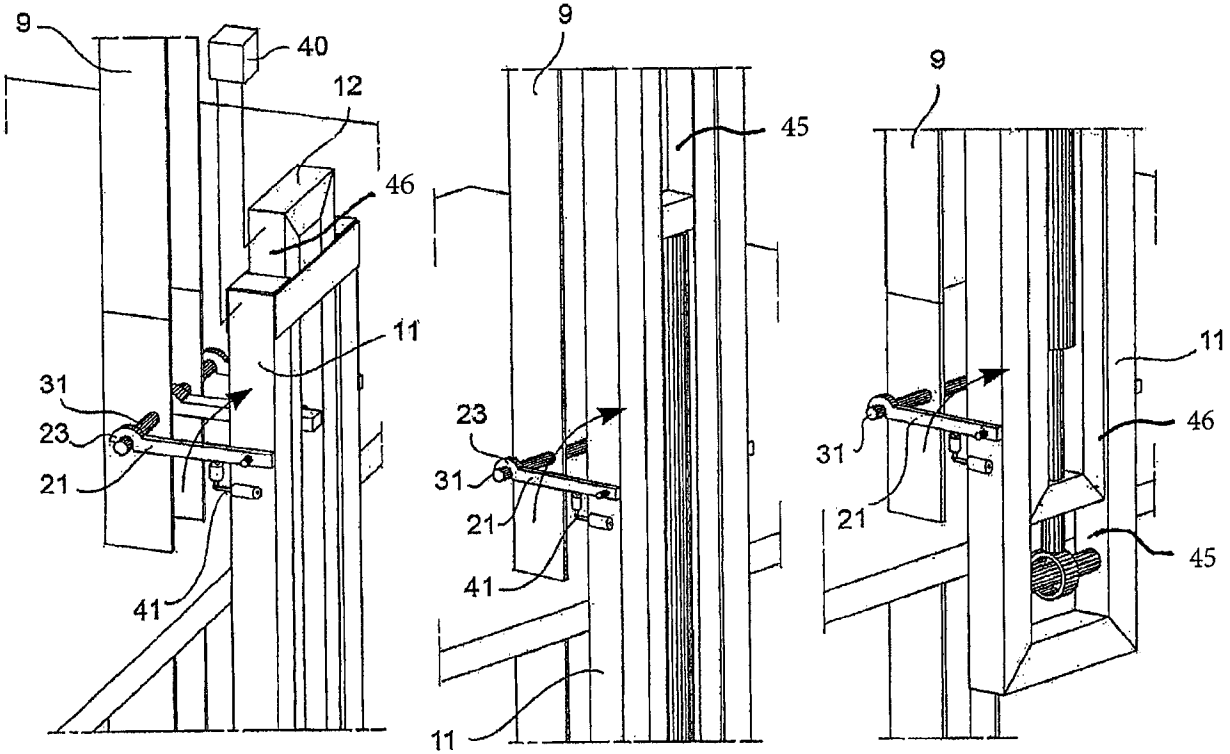
FIGS. 8, 9 and 10 are axonometric views which illustrate details of an upper, intermediate and lower portion of equipment according to an embodiment, respectively.
Figure 13:
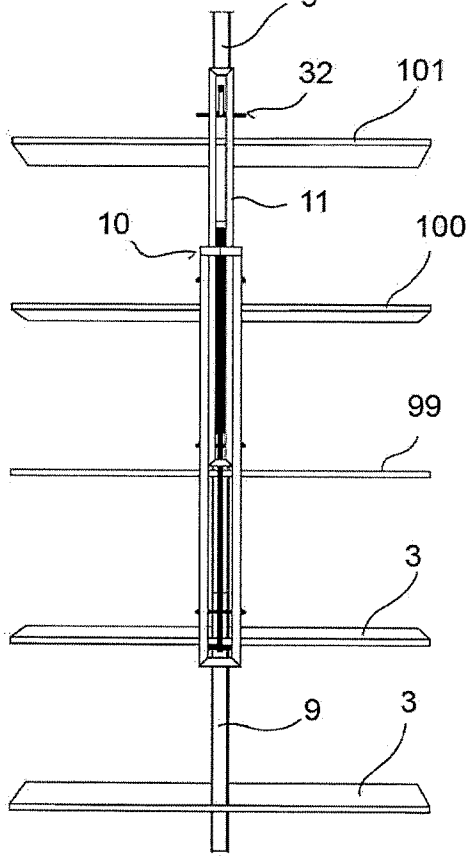
FIGS. 11, 12 and 13 are axonometric or perspective views which illustrate details of equipment according to an embodiment, as well as a step of a method according to a possible mode of operation.
Figure 12:
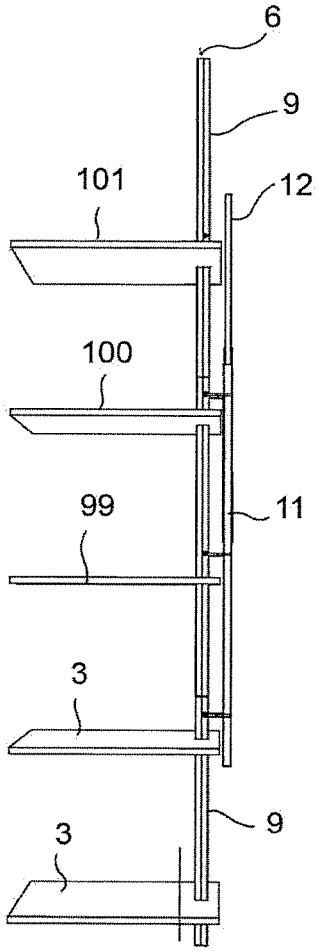
Figure 11:
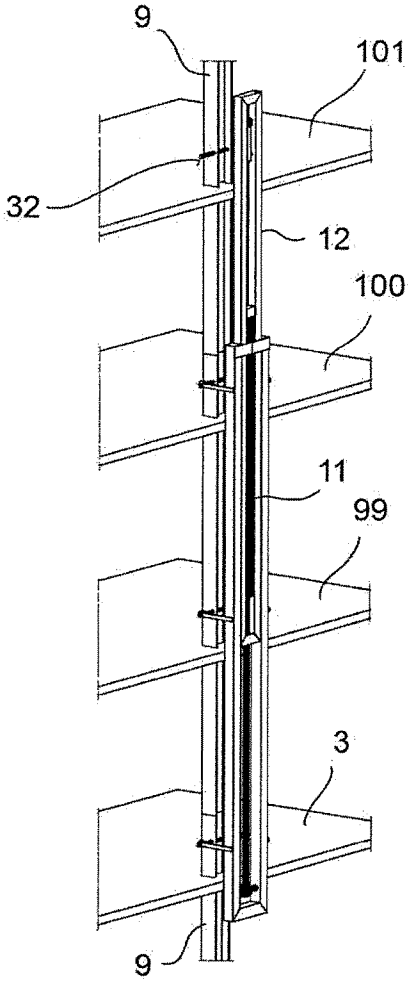
Figure 16:
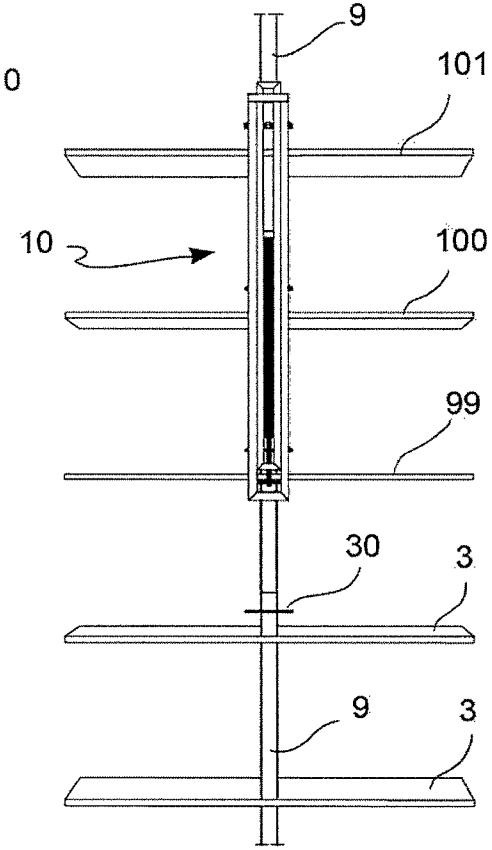
FIGS. 14, 15 and 16 are axonometric or perspective views which illustrate details of equipment according to an embodiment, as well as a step of a method according to a possible mode of operation.
Figure 15:
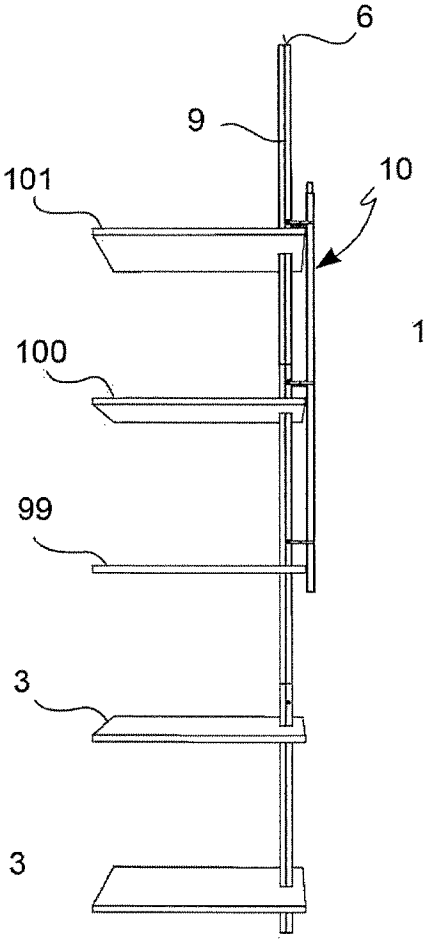
Figure 14:
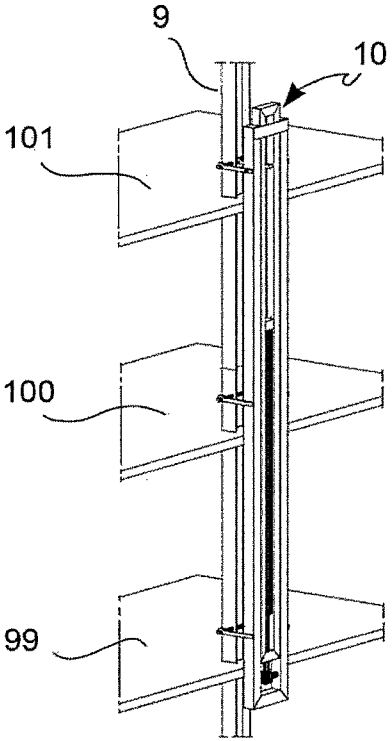
Figures 17, 18, 19, 20, 21:
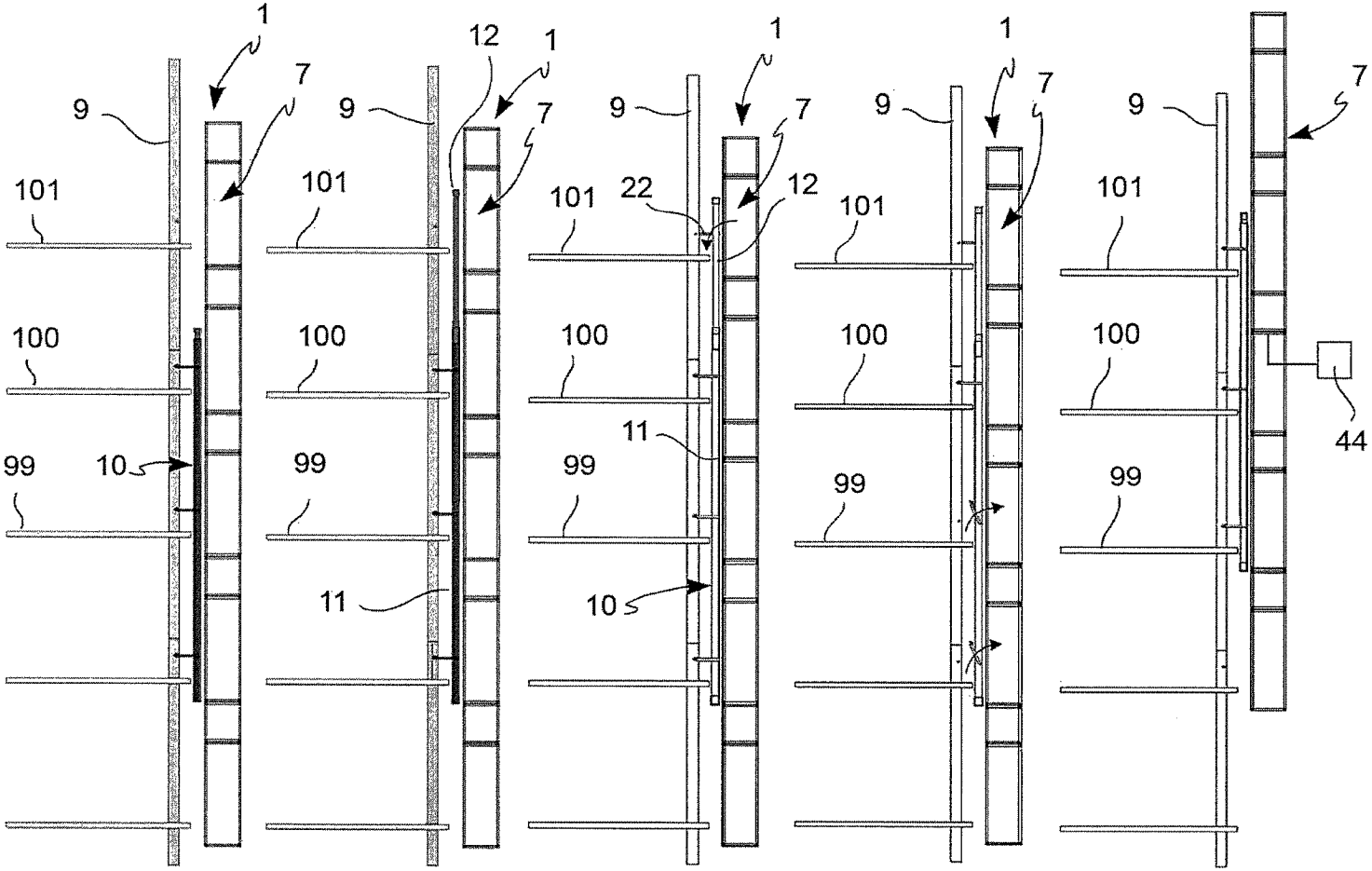
FIGS. 17 to 21 are axonometric or perspective views which illustrate details of equipment according to an embodiment, as well as some steps of a method according to a possible mode of operation.
Figure 23:
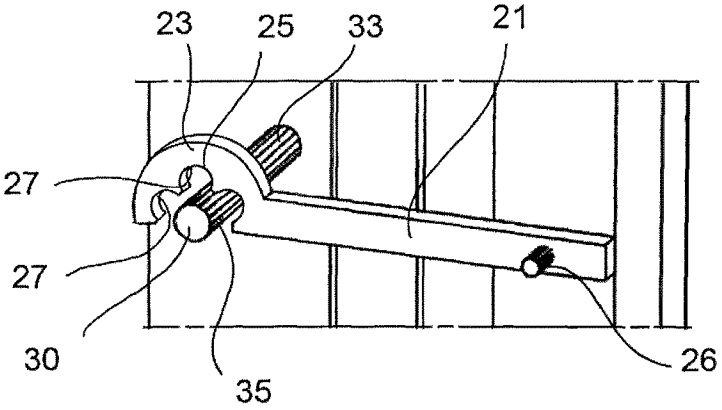
FIGS. 22 to 25 are axonometric views which illustrate some embodiments of a coupling element.
Figure 25:
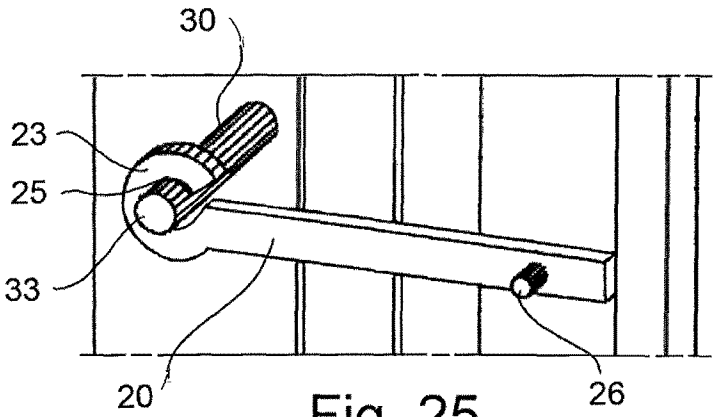
Figure 22:
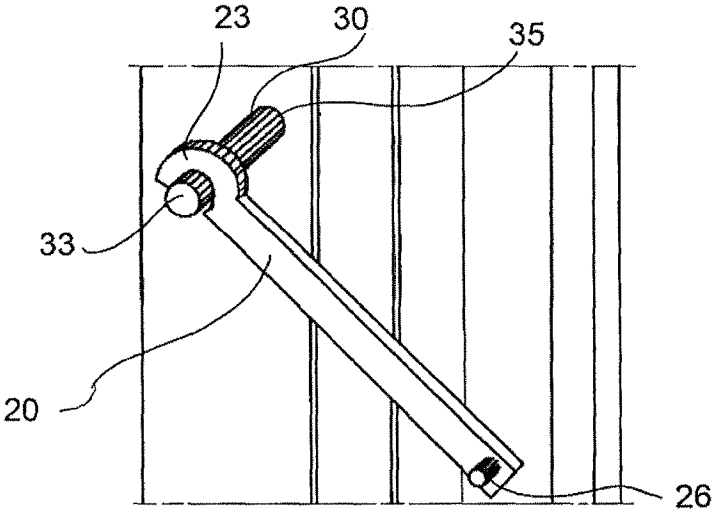
Figure 24:
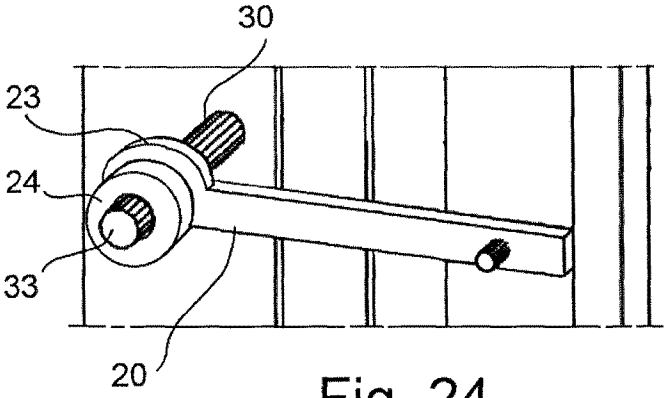
Figure 26:
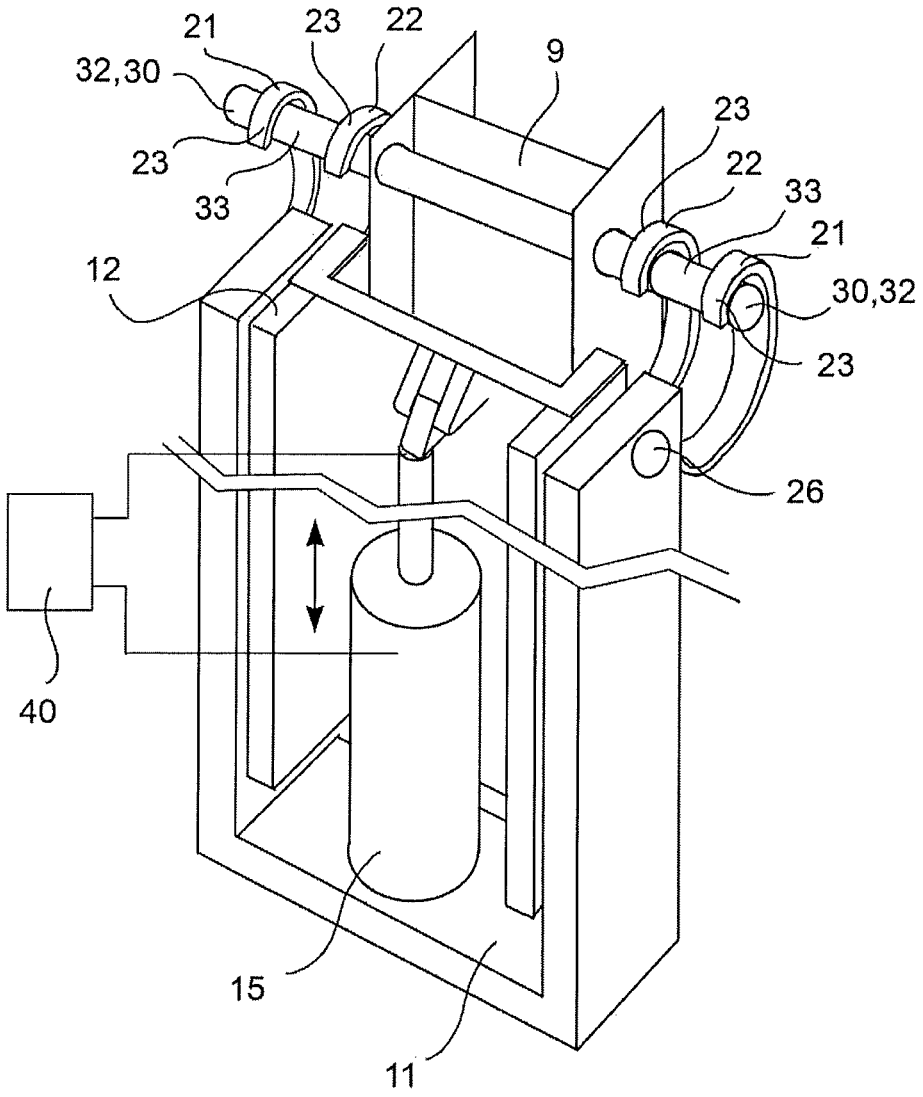
FIG. 26 is a perspective diagram showing details of equipment, according to an embodiment of the invention.
Figure 27:
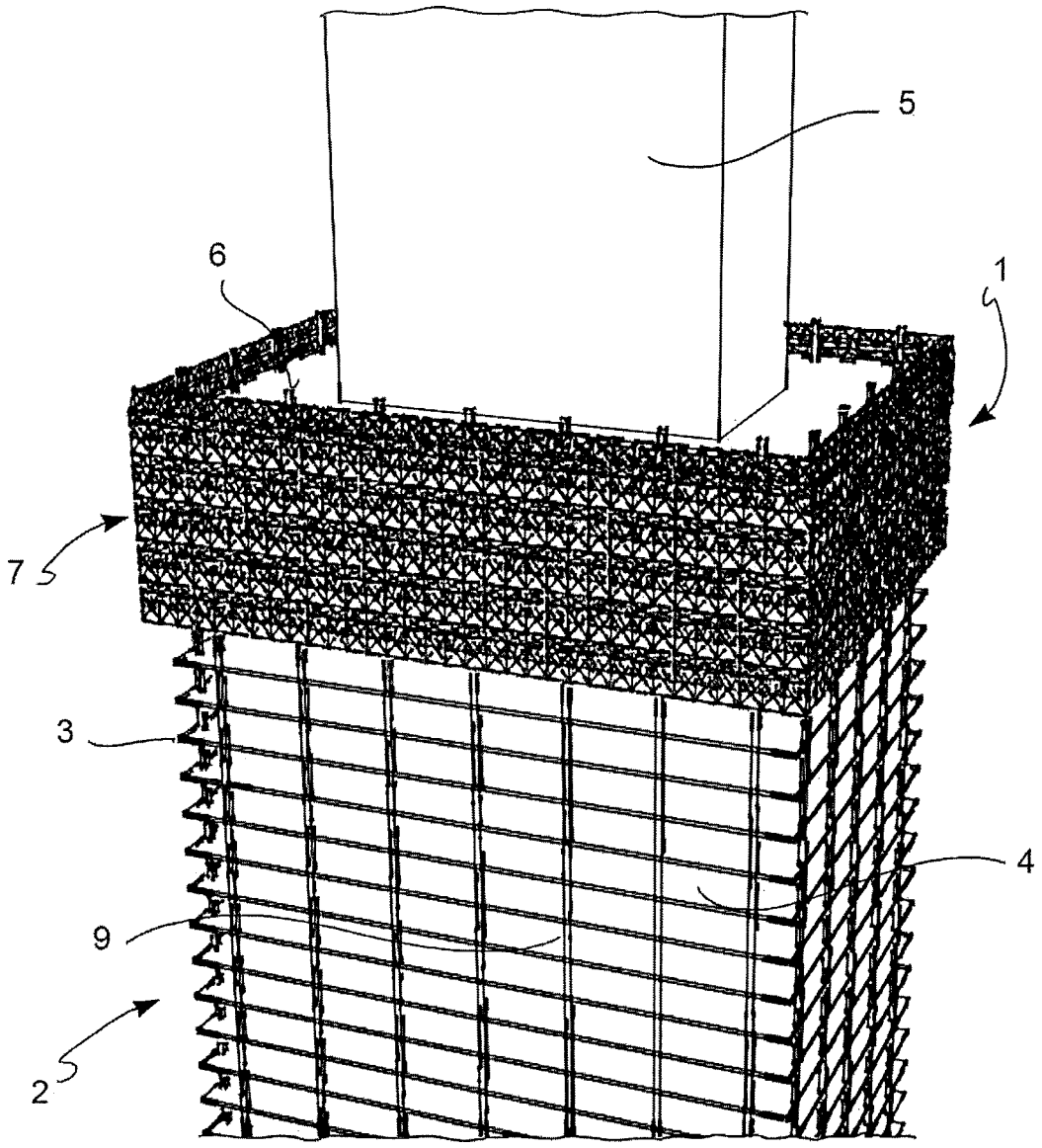
FIG. 27 is an axonometric view which shows climbing equipment for the construction of buildings according to an embodiment.
Figure 28:
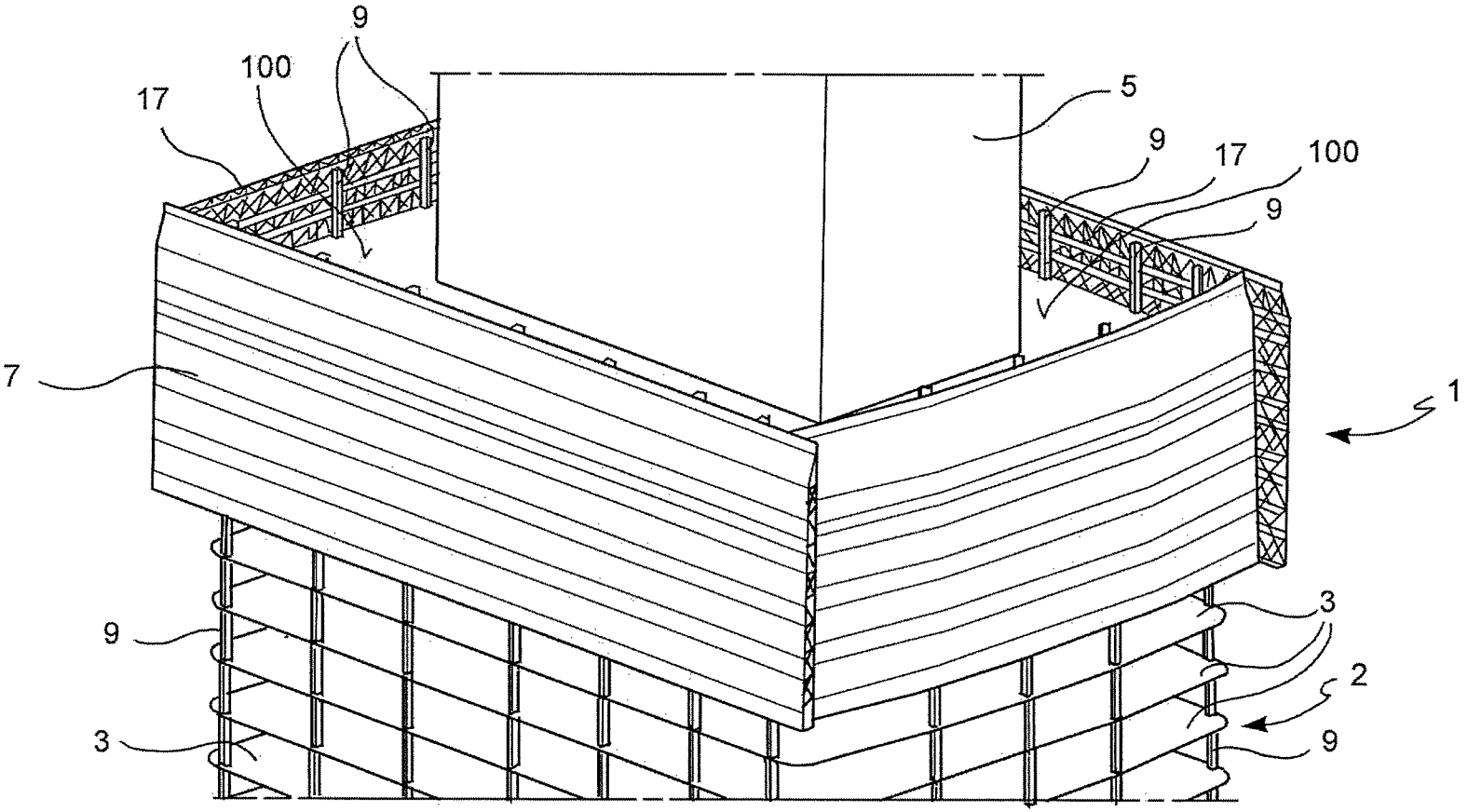
FIG. 28 is an axonometric view which shows climbing equipment for the construction of buildings according to an embodiment and a portion of building under construction.
Figure 29:
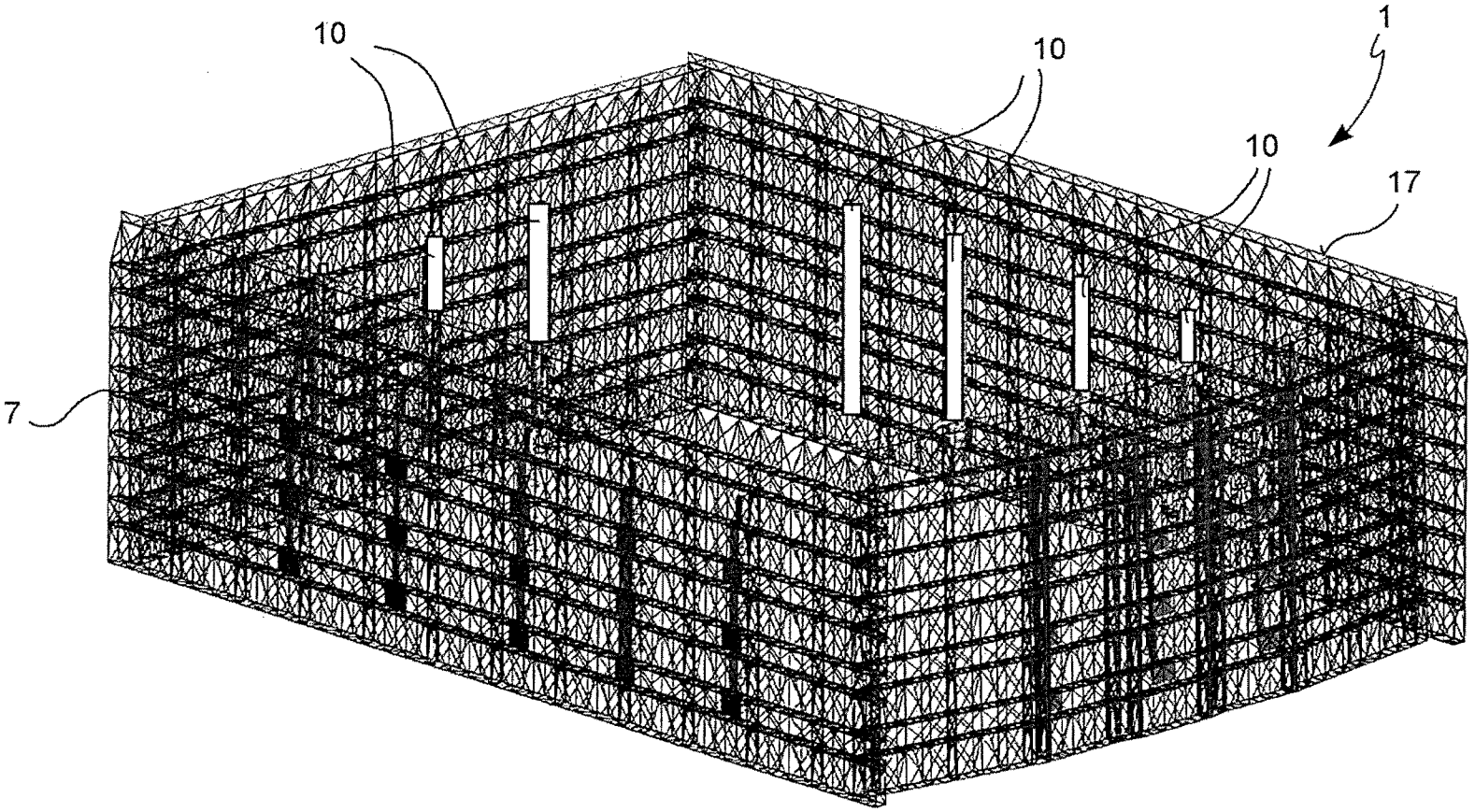
FIG. 29 is an axonometric view which shows climbing equipment for the construction of buildings according to an embodiment.
Figure 30:
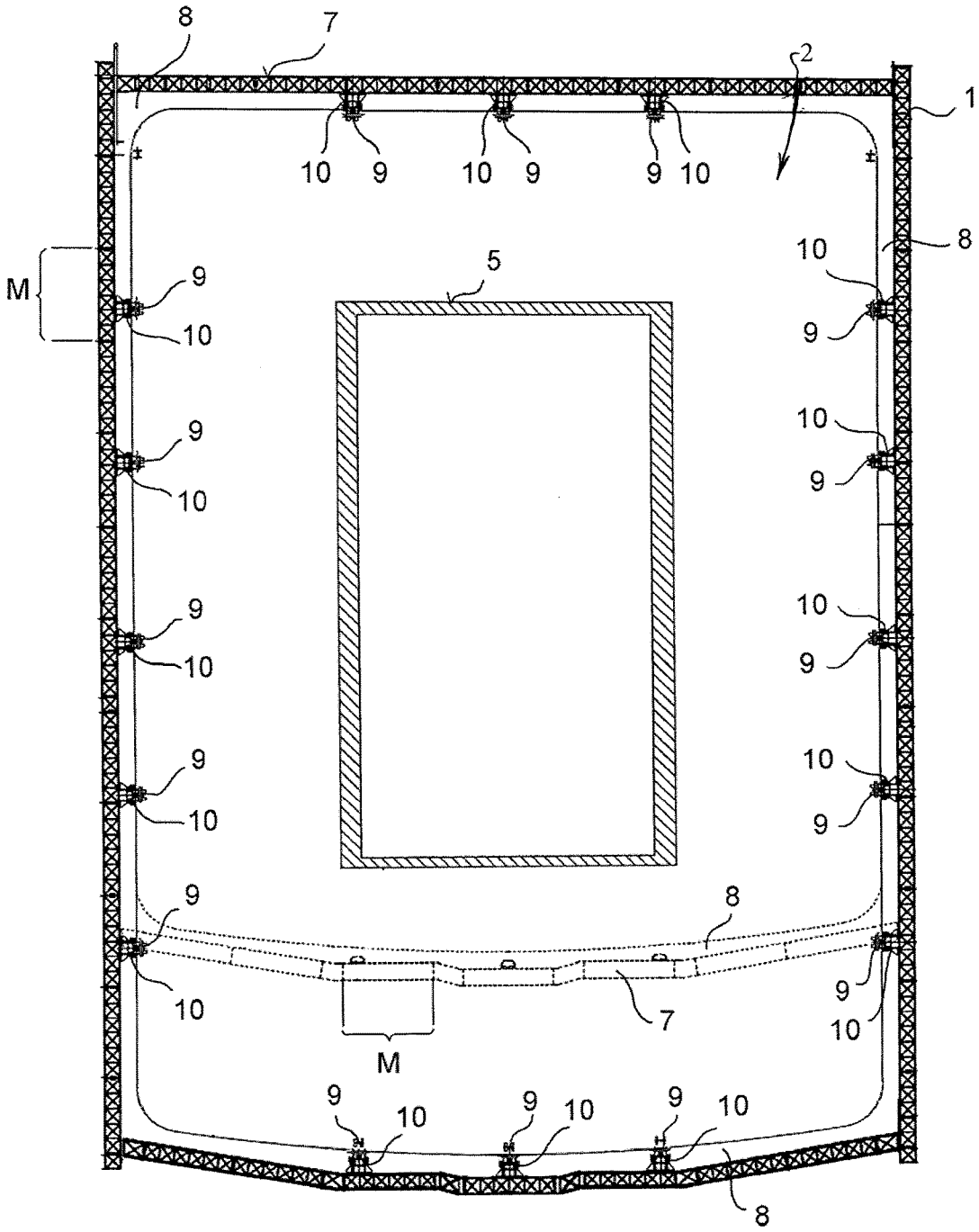
FIG. 30 is a cross section of a building under construction having floors of different surface area, in which the profile of a floor lower than one shown in cross section is illustrated with a dashed line and in which climbing equipment for the construction of buildings is shown, according to an embodiment.
Figure 31:
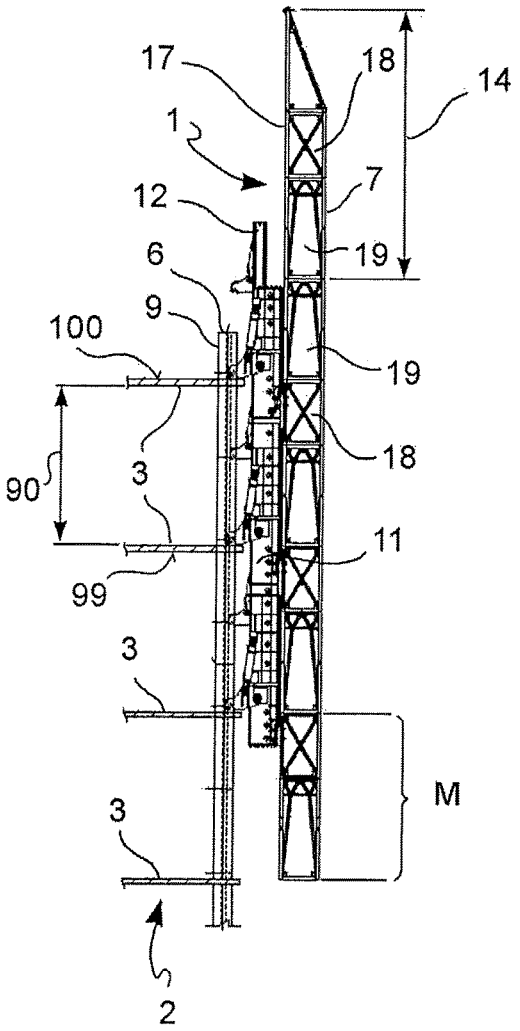
FIG. 31 is a schematic section which shows a vertical elevation view of a portion of climbing equipment for the construction of buildings comprising a scaffold portion according to an embodiment coupled to a temporary top portion of a building under construction.
Figure 32:
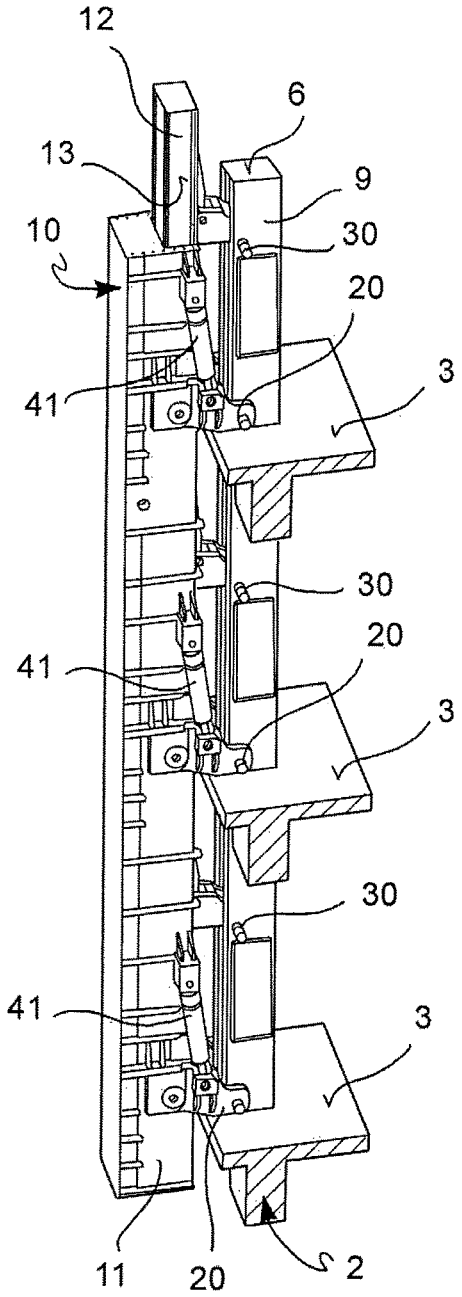
FIG. 32 is an axonometric view of a diagrammatic section of a portion of a traction device, according to an embodiment coupled to a temporary top portion of a building under construction.
Figure 33:
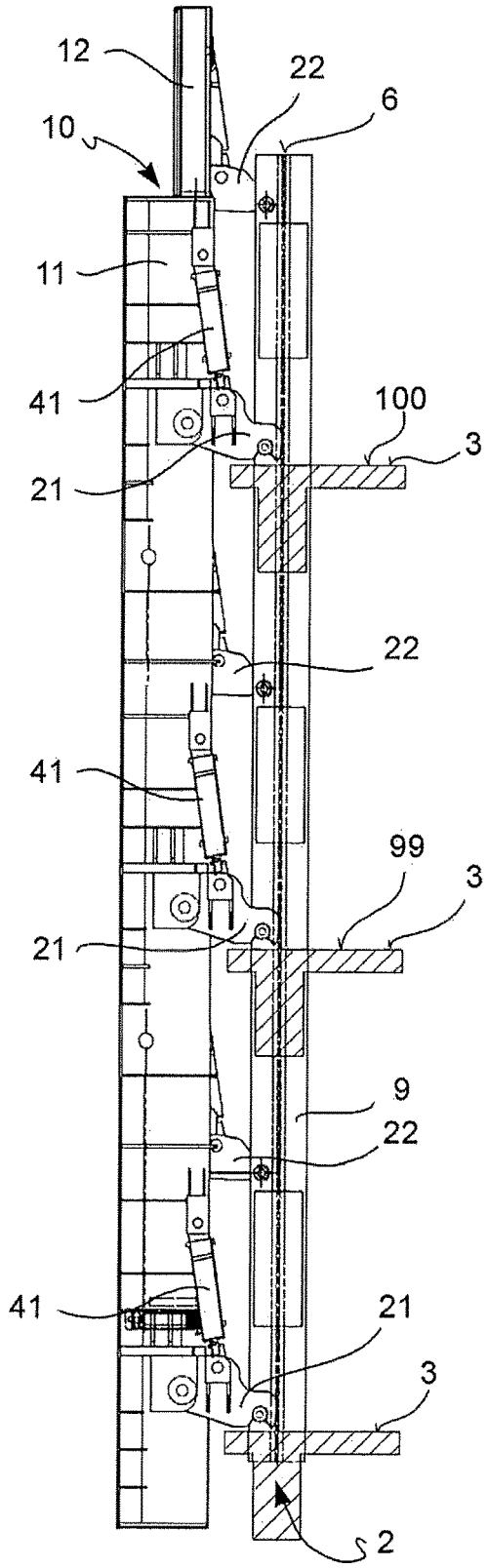
FIG. 33 is a vertical elevation view of the diagrammatic section in FIG. 32.
Figure 34:
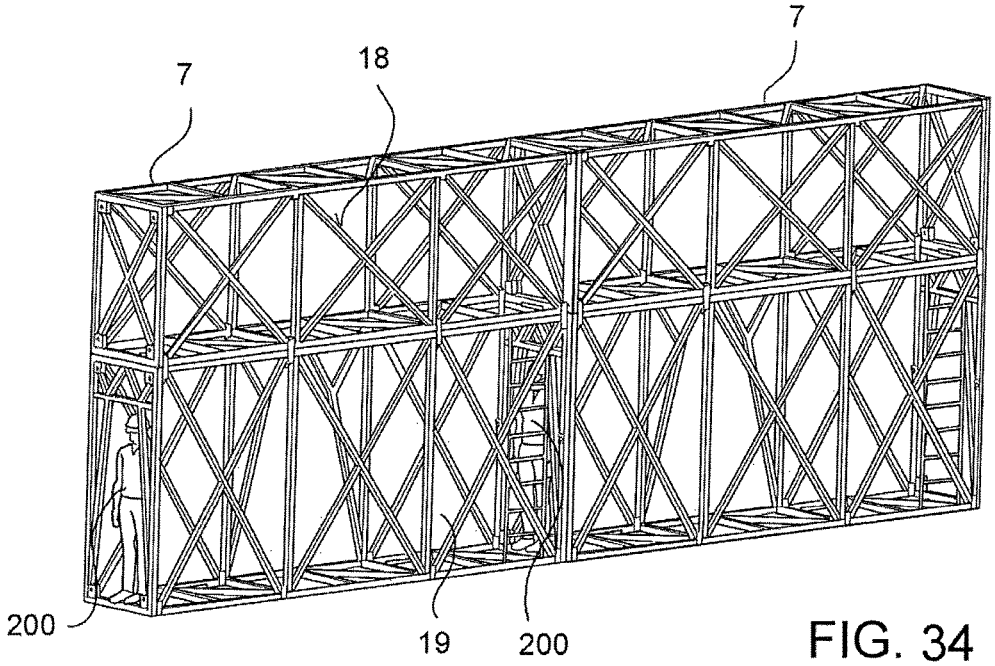
FIG. 34 is an axonometric view of a scaffold portion comprising an anchoring module and a working module, according to an embodiment.
Figure 35:
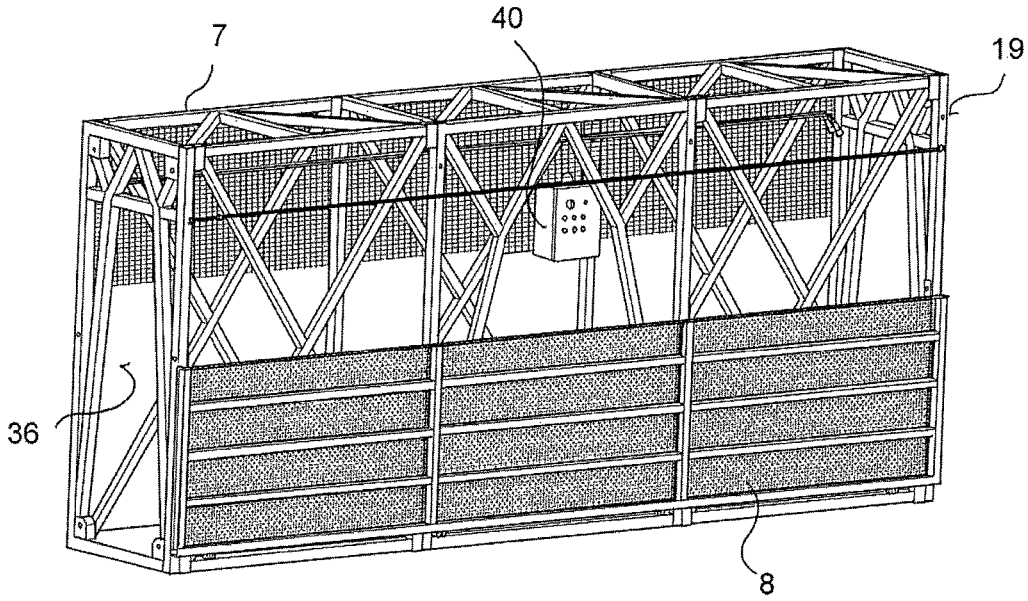
FIGS. 35 and 36 are axonometric views of a working module of a scaffold comprising a overturnable work platform in a retracted position and in an extended position, respectively.
Figure 36:
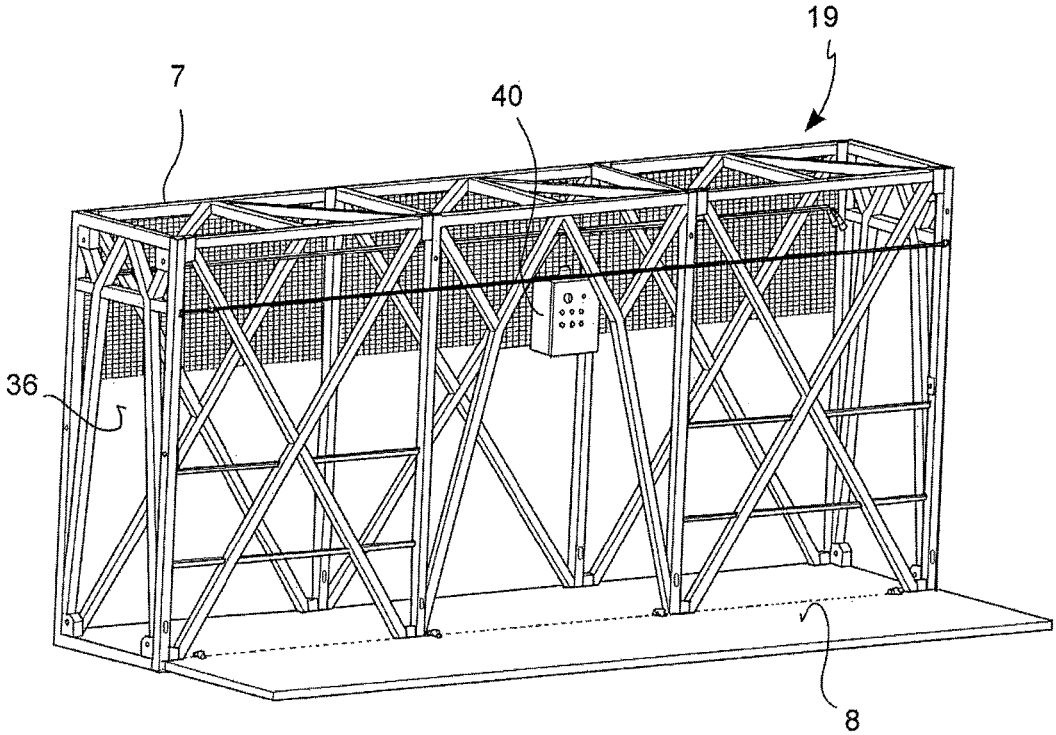
Figures 37A, 37B, 37C, 37D:
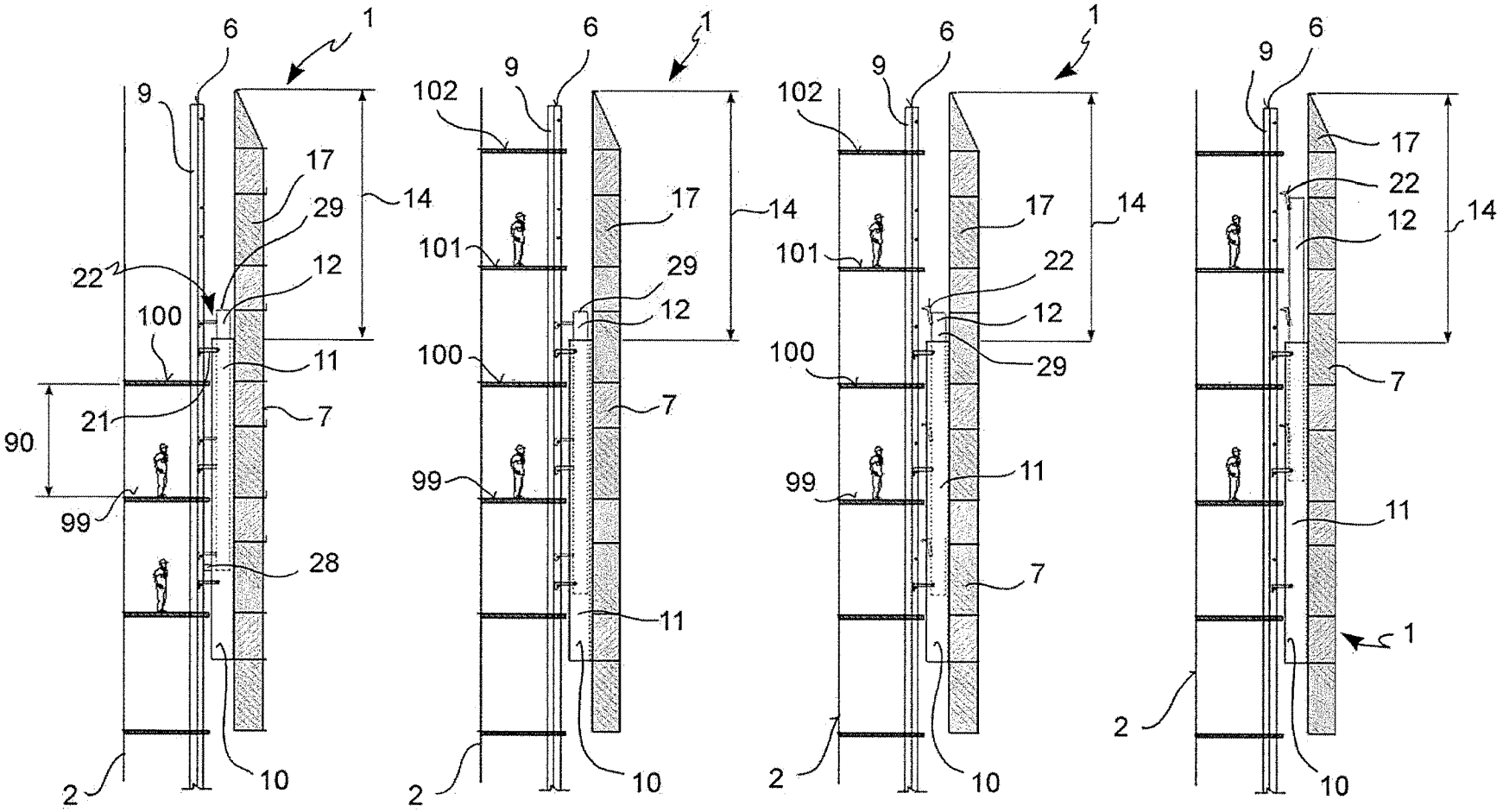
FIGS. 37 *a-h* are schematic views which illustrate some steps of a climbing method according to a possible mode of operation.
Figures 37E, 37F, 37G, 37H:
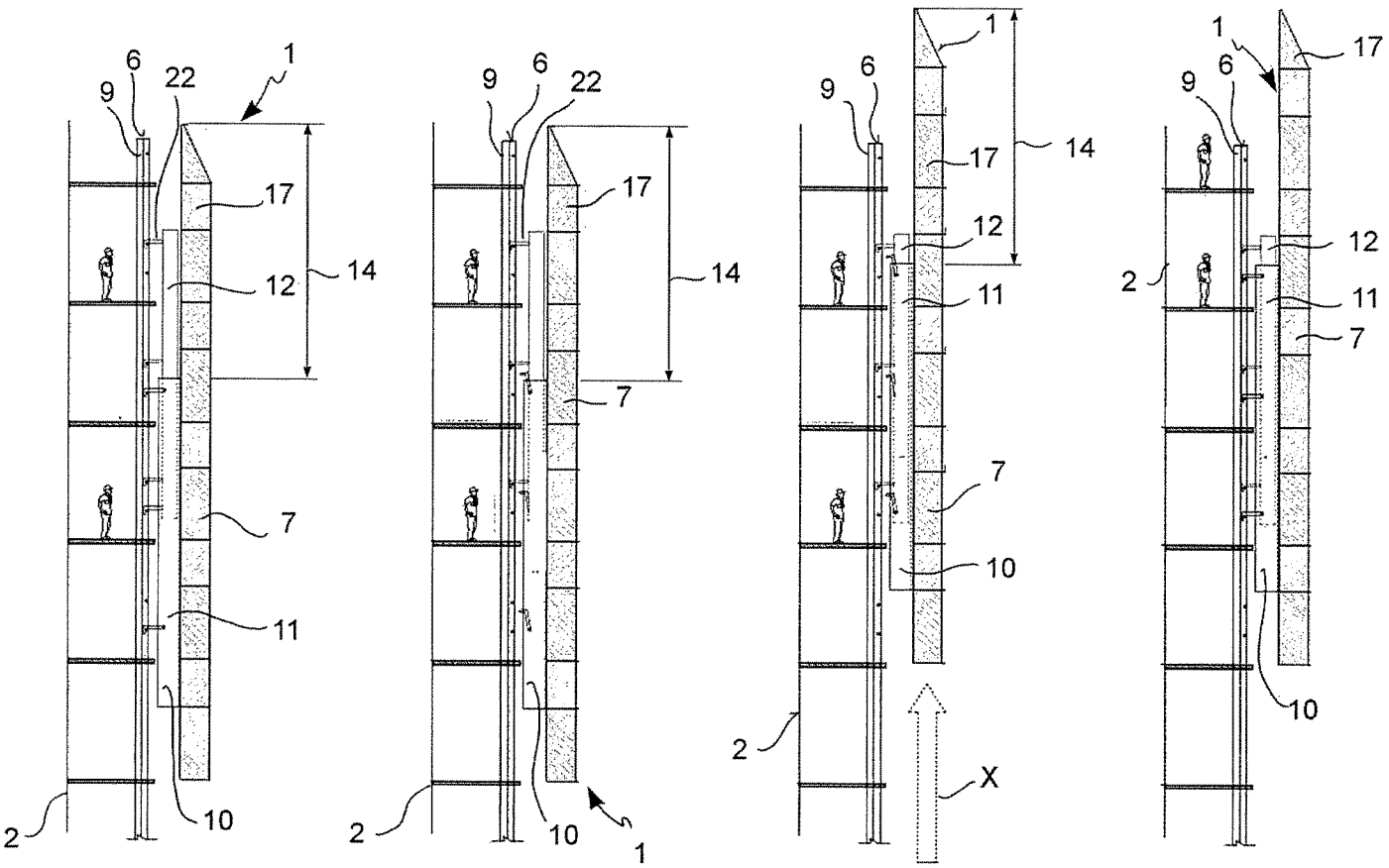

According to a possible mode of operation, FIGS. 5 to 7 show a possible step of a climbing method, in which the climbing device 10 is anchored by the first portion 11 to a temporary top floor 100. As shown in the FIGS. 11 to 13, the traction device 10 is then taken to an extended configuration, which makes it adapted to be anchored with the second portion 12 to a first top floor 101, arranged at a higher level than the temporary top floor 100. As shown in the FIGS. 14 to 16, the traction device 10 is then taken to a contracted configuration anchored by its first portion 11 to the first upper floor 101.

According to a possible mode of operation, a climbing method comprises at least one step in which the first portion 11 and the second portion 12 of the traction device 10 are simultaneously anchored to the same building floor 3, e.g. to the first upper floor 101.

A descending climbing method will be described below.

A climbing method comprises the following steps, provided in the following order:

providing climbing equipment 1 according to any one of the embodiments described herein;

anchoring the climbing equipment to a temporary top floor 100;

anchoring a second portion 12 of the traction device 10 to the first lower floor 99;

moving the second portion 12 of the traction device 10;

lowering the scaffold 7.

By virtue of the features described above, provided either separately or in combination, where applicable, in particular embodiments, it is possible to satisfy the sometimes contrasting needs disclosed above, and to obtain the aforesaid advantages, in particular:

the lower floors of the building under construction 2 can be made rapidly usable, while the upper floors of the building are being built;

safety is improved for workers 200;

better protection from the accidental falling of objects or building materials from the scaffold 7 is provided;

a more rapid and agile ascent of the building under construction 2 is provided by the climbing equipment 1;

a quicker and safer construction of the upper floors to the temporary top floor 100 of the building under construction 2 is allowed;

encumbering the temporary top of the pillars 9 of the building under construction 2 and the previously built lower floors of the building under construction is avoided;

a reliable method for achieving an agile, quick and safe ascent of the building under construction is provided.

Those skilled in art may make many changes and adaptations to the embodiments described above or may replace elements with others which are functionally equivalent in order to satisfy contingent needs without however departing from the scope of the appended claims.

What is claimed is:

1. Climbing equipment for construction of a building, or a building under construction, the building under construction comprising a plurality of building floors, each building floor having a perimeter and a height, the climbing equipment comprising:

at least one scaffold adapted to surround at least partially the perimeter of at least one building floor, the scaffold comprising at least one work platform adapted to form a walkable surface and adapted to project in a cantilever manner from the scaffold towards the building under construction, wherein at least some of the work platform is adapted to close an open space between the scaffold and the building under construction;

a traction device comprising at least a first portion integral with the scaffold, and at least a second portion slidingly connected to the first portion, the first portion being slidably connected to the second portion by sliding guides provided on the first portion and sliding runners provided on the second portion, or by sliding guides provided on the second portion and sliding runners provided on the first portion, wherein the first portion comprises at least a first hook and the second portion comprises at least a second hook, and wherein the first hook is rotatable so as to releasably engage and disengage one of a plurality of coupling pins projecting from the building under construction, and wherein the second hook is rotatable so as to releasably engage and disengage another one of the plurality of coupling pins projecting from the building under construction, and wherein the coupling pins are arranged at different vertical levels of the building under construction; and a moving system, adapted to perform a relative movement between the first portion and the second portion of the traction device, wherein, when the first hook or the second hook is released from one of the plurality of coupling pins of the building under construction, the moving system is adapted to perform the relative movement between the first portion and the second portion of the traction device, so as to move the scaffold in a direction of relative movement (X);

wherein the scaffold includes a portion which extends upwardly above the traction device in a direction parallel to the direction of relative movement (X) between the first portion and second portion of the traction device, the scaffold extending upwardly above the first portion of the traction device by a predetermined amount, and wherein the predetermined amount is at least equal to the height of one building floor; and wherein the portion of the scaffold which extends upwardly above the traction device surrounds a top floor of the building under construction and a space above the top floor of the building under construction, wherein the portion of the scaffold extending upwardly above the traction device comprises at least one working module comprising at least one walkable surface and defining at least one working space adapted to accommodate one or more operators.

2. The equipment according to claim 1, wherein the predetermined amount is at least equal to the height of two building floors.

3. The equipment according to claim 1, wherein the work platform is expandable between an extended position, in which the work platform forms a walkable surface which projects like a cantilever from the scaffold towards the building under construction, and at least one retracted position, in which the work platform is contained within a clearance of the scaffold.

4. The equipment according to claim 1, wherein the first hook and the second hook each comprise a peg seat, adapted to at least partially accommodate a corresponding one of the coupling pins.

5. The equipment according to claim 1, wherein the first hook is rotationally connected to the first portion of the traction device and wherein the first hook is adapted to project in a cantilever manner from the first portion of the traction device, like a shelf; and wherein the second hook is rotationally connected to the second portion of the traction device; and wherein the second hook is adapted to project in a cantilever manner from the second portion of the traction device.

6. The equipment according to claim 5, wherein the first hook is connected to a first actuator for moving the first hook between a coupling position, in which the first hook is anchored to one of the plurality of coupling pins, and a releasing position, in which the first hook is not in contact with one of the plurality of coupling pins, and wherein the second hook is connected to a second actuator for moving the second hook between a coupling position, in which the second hook is anchored to one of the plurality of coupling pins, and a releasing position, in which the second hook is not in contact with one of the plurality of coupling pins.

7. The equipment according to claim 6, wherein the first actuator extends upwards from the first hook to the first portion of the traction device, and wherein the second actuator extends upwards from the second hook to the second portion of the traction device.

8. The equipment according to claim 1, wherein the scaffold is a modular scaffold, comprising a plurality of modular scaffold units connectable to form a scaffold having a predetermined height extension and wherein the plurality of modular scaffold units are connectable to form a scaffold having a predetermined extension about the building under construction.

9. The equipment according to claim 1, comprising a plurality of said traction devices and a plurality of said moving systems distributed about an outer face of the building under construction and connected to the plurality of said traction devices, and wherein the plurality of traction devices and the plurality of moving systems are controlled in a monitored manner and using feedback from displacement sensors so as to keep the scaffold at a desired level or at a desired height both when the scaffold is stationary and when the scaffold is moving, and wherein the plurality of traction devices and the plurality of moving systems are controlled in a monitored manner and using feedback from inclination sensors so as to keep the scaffold horizontal both when the scaffold is stationary and when the scaffold is moving.

10. The equipment according to claim 1, wherein the traction device comprises a layer interposed between the first portion of the traction device and the second portion of the traction device, the layer formed of a material to facilitate sliding between the first portion and the second portion of the traction device.

* * * * *